US007860431B2

(12) United States Patent
Kitamura et al.

(10) Patent No.: US 7,860,431 B2
(45) **Date of Patent: *Dec. 28, 2010**

(54) IMAGE FORMING APPARATUS HAVING A SINGLE DEVICE FOR DETECTING WHEN COVERS OF THE APPARATUS ARE ALL CLOSED

(75) Inventors: Makoto Kitamura, Tokyo (JP); Masahiro Fukuda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/591,034

(22) Filed: Nov. 5, 2009

(65) Prior Publication Data

US 2010/0054801 A1 Mar. 4, 2010

Related U.S. Application Data

(62) Division of application No. 11/527,542, filed on Sep. 27, 2006, now Pat. No. 7,636,530.

(30) Foreign Application Priority Data

Sep. 30, 2005 (JP) ..... 2005-286139
May 10, 2006 (JP) ..... 2006-131518

(51) Int. Cl.
*G03G 15/00* (2006.01)

(52) U.S. Cl. ..... 399/107

(58) Field of Classification Search ..... 399/110, 399/107, 124

See application file for complete search history.

(56) References Cited

U.S. PATENT DOCUMENTS

| | | | | |
|---|---|---|---|---|
| 6,647,223 | B2 | 11/2003 | Ishii | |
| 7,386,252 | B2 | 6/2008 | Portig et al. | |
| 7,636,530 | B2 * | 12/2009 | Kitamura et al. | 399/107 |
| 2004/0041333 | A1 | 3/2004 | Izumi et al. | |
| 2006/0239715 | A1 | 10/2006 | Lee et al. | |

FOREIGN PATENT DOCUMENTS

| | | |
|---|---|---|
| JP | 7-92879 | 4/1995 |
| JP | 2004-154975 | 6/2004 |
| JP | 2005-111896 | 4/2005 |

* cited by examiner

*Primary Examiner*—Susan S Lee
(74) *Attorney, Agent, or Firm*—Rabin & Berdo, PC

(57) ABSTRACT

An image forming apparatus employs a device that detects the opening and closing of covers. Two covers are pivotally mounted to a body of the image forming apparatus, each of the two covers being movable either to its opening position to open with respect to the image forming apparatus or to its closing position to close with respect to the image forming apparatus. A movable member is positioned at a first position when both the two covers are at their opening positions. A micro switch detects whether the two covers are closed or opened with respect to the image forming apparatus. When one of the two covers has moved to its closing position causing the movable member to move to a second position and the other of the two covers is at its closing position, the detector detects that the two covers are closed.

8 Claims, 23 Drawing Sheets

IMAGE FORMING APPARATUS HAVING A SINGLE DEVICE FOR DETECTING WHEN COVERS OF THE APPARATUS ARE ALL CLOSED

This is a Divisional of U.S. application Ser. No. 11/527,542, filed on Sep. 27, 2006, now U.S. Pat. No. 7,636,530 and allowed on Aug. 10, 2009, the subject matter of which is incorporated herein by reference.

BACKGROUND OF THE INVENTION

1. Field of the Invention

The present invention relates to an image forming apparatus, and more particularly to an image forming apparatus provided with a plurality of opening/closing components.

2. Description of the Related Art

A conventional image forming apparatus is provided with a cover or lid which is opened when a consumable item is replaced or jammed paper is removed. Some apparatuses are provided with more than one cover. The apparatus is usually designed such that the apparatus remains inoperable when the covers are open. Therefore, detection switches are provided for individual covers to detect whether the covers are open or closed. Some apparatuses are provided with detection switches for paper cassettes to detect whether the paper cassettes are properly attached.

Provision of a detection switch for each cover necessitates routing electrical wires for each switch and/or hardware such as an I/O port of a control circuit. This increases the manufacturing cost of the apparatus.

SUMMARY OF THE INVENTION

An object of the invention is to provide an image forming apparatus in which a single detector is used to simultaneously detect whether a plurality of covers are open or closed.

An image forming apparatus employs a device that detects the opening and closing of covers. Two covers are pivotally mounted to a body of the image forming apparatus, each of the two covers being movable either to its opening position to open with respect to the image forming apparatus or to its closing position to close with respect to the image forming apparatus. A movable member is positioned at a first position when both the two covers are at their opening positions. A micro switch detects whether the two covers are closed or opened with respect to the image forming apparatus. When one of the two covers has moved to its closing position causing the movable member to move to a second position and the other of the two covers is at its closing position, the detector detects that the two covers are closed.

The detector is a micro switch, the micro switch being in one state when said two covers are at their closing positions and in another state when at least one of said two covers is at its opening position.

The image forming apparatus further includes an urging member that exerts an urging force on the movable member in a first direction. A first one of the two covers moves from its opening position to its closing position in a second direction opposite to the first direction causing the movable member to move against the urging force to the second position.

The image forming apparatus further includes an urging member that exerts an urging force on the movable member in a first direction. A first one of the two covers moves from its opening position to its closing position in a second direction opposite to the first direction to cause the movable member to move against the urging force to the second position.

The detector is mounted on the movable member. When the first one of the two covers is at its closing position, a second one of the two covers moves to its closing position, causing the micro switch to shift.

The detector is mounted on the movable member, wherein after a second one of the two covers has moved to its closing position, the first one of the two covers moves to its closing position causing the micro switch to shift.

The movable member includes a bar that pivots about an axis. After the first one of the two covers has moved from its opening position to its closing position to push the movable member to the second position, a second one of the two covers moves from its opening position to its closing position to push the bar to pivot so that the bar causes the micro switch to shift.

The movable member includes a bar that pivots about an axis. The first one of the two covers moves to its closing position after a second one of the two covers has moved from its opening position to its closing position to push the bar to pivot, so that the first one of the two covers pushes the movable member to the second position causing the bar to shift the micro switch.

The movable member includes a swing member that swings about an axis. After the first one of the two covers has moved to its closing position to push the movable member to move against an urging force of the urging member to the second position, a second one of the two covers moves to its closing position causing the swing member to shift the micro switch.

The swing member has two surfaces that form a taper such that the swing member is thicker at the axis than it is at its free end, wherein the swing member is sandwiched between the micro switch and the second one of the two covers so that the tapered swing member causes the micro switch to shift.

The swing member has a surface that moves into sliding engagement with a surface of the second one of the two covers, the surface being configured to mate with the surface.

Each of the two covers includes a corresponding engagement portion that includes a support portion, a cap that fits over the support portion, and an urging member that urges the cap in a direction from the opening position toward the closing position. When one of the two covers is moved from its opening position to its closing position, the corresponding engagement portion abuts the movable member. When the other of the two covers is moved from its opening position to its closing position, the corresponding engagement portion abuts the swing member.

The movable member includes a swing member that swings about an axis. After a second one of the two covers has moved to its closing position, the first one of the two covers moves to its closing position to push the movable member to move against an urging force of the urging member to the second position, causing the swing member to shift the micro switch.

The swing member has two surfaces that form a taper such that the swing member is thicker at the axis than it is at its free end, wherein when the first one of the two covers moves from its opening position to its closing position to push the movable member against the urging force of the urging member, the free end of the swing member enters a gap between the micro switch and the second one of the two covers so that the tapered swing member causes the micro switch to shift.

The swing member has a surface that moves into sliding engagement with a surface of the second one of the two covers, the surface being configured to mate with the surface.

Each of the two covers includes a corresponding engagement portion that includes a support portion, a cap that fits over the support portion, and an urging member that urges the cap in a direction from the opening position toward the closing position. When one of the two covers is moved from its opening position to its closing position, the corresponding engagement portion abuts the movable member. When the other of the two covers is moved from its opening position to its closing position, the corresponding engagement portion abuts the swing member.

The movable member includes a cam that rotates about an axis and that is urged by an urging member in a first direction. After a first one of the two covers has moved from its opening position to its closing position to push the cam to rotate against an urging force of the urging member, a second one of the two covers moves from its opening position to its closing position to push the movable member to the second position, the cam rotating to cause the micro switch to shift.

The cam has a circular edge. When the cam rotates, the circular edge moves into engagement with the micro switch to shift the micro switch.

The movable member includes a cam that rotates about an axis and that is urged by an urging member in a first direction (J). A first one of the two covers moves from its opening position to its closing position to push the cam to rotate against an urging force of the urging member after a second one of the two covers moves from its opening position to its closing position to push the movable member to the second position, the cam rotating to cause the micro switch to shift.

The cam has a circular edge. When the cam rotates, the circular edge moves into engagement with the micro switch to shift the micro switch.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
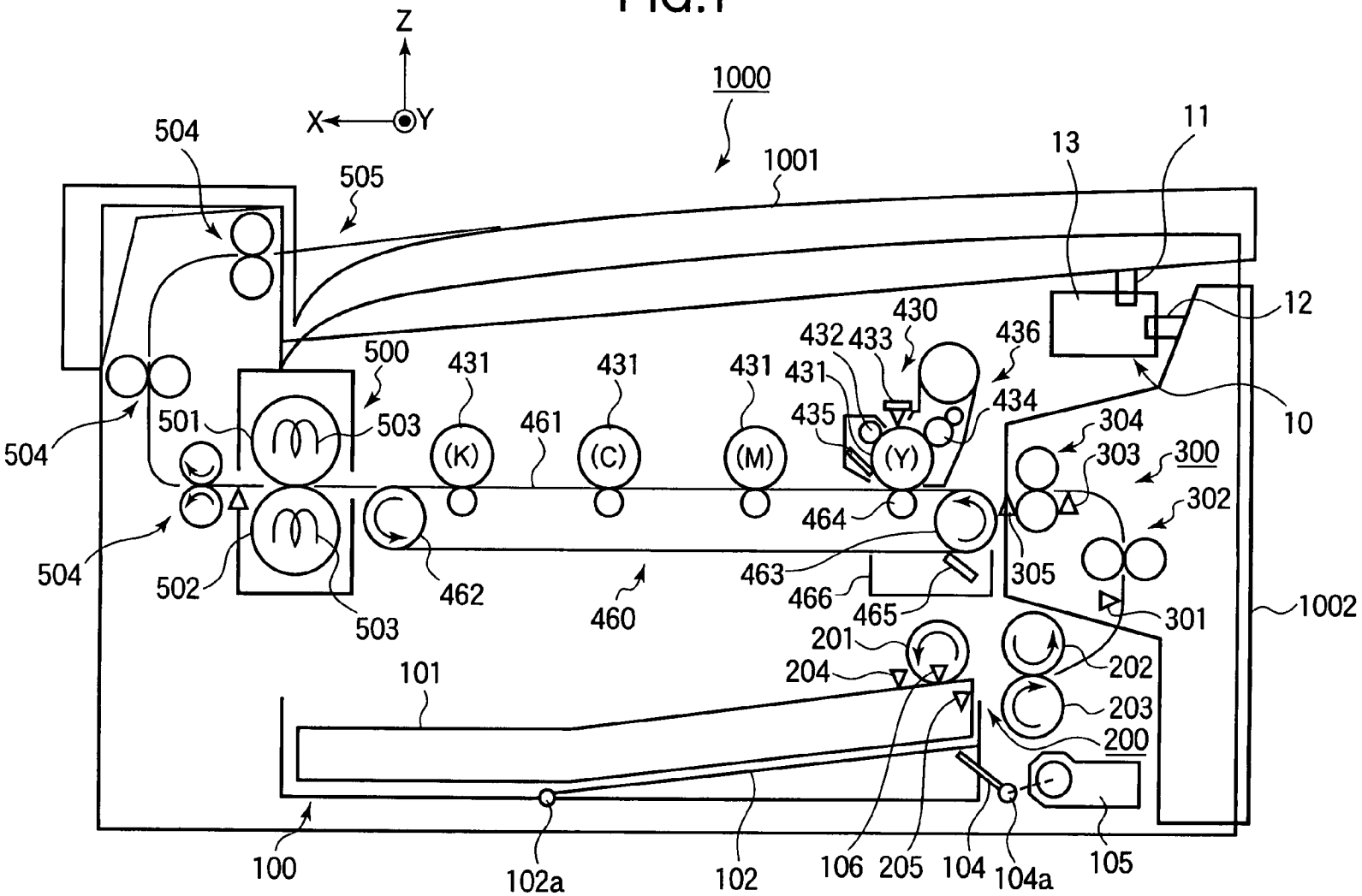
FIG. 1 illustrates a pertinent portion of an image forming apparatus of a first embodiment.

FIG. 1 illustrates a pertinent portion of an image forming apparatus 1000 of a first embodiment.

The image forming apparatus 1000 is configured as an electrophotographic printer. A paper tray 100 is detachably attached to the image forming apparatus 1000, and holds a stack of paper 101 in it. A sheet support platform 102 is provided in the paper tray 100, and pivots about a shaft 102*a*. The sheet support platform 102 supports a little more than front half of the stack of paper 101. The paper tray 102 also includes a guide member, not shown, that determines positions at which the stack of paper 101 should be in a paper transporting direction (perpendicular to the paper, Y-direction) and an anteroposterior direction (X-direction) perpendicular to the paper transporting direction.

A lift-up bar 104 is rotatably supported on a supporting shaft 104*a*. The supporting shaft 104*a* may be connected to and disconnected from a motor 105. When the paper tray 100 has been attached into the image forming apparatus 1000, the lift-up bar 104 is brought into connection to the motor 105 and a controller, not shown, becomes ready to drive the motor 105 in rotation. When the motor 105 rotates, the lift-up lever 104 rotates about the shaft 104*a* so that the tip of the lift-up lever 104 lifts the bottom of the sheet support platform 102 to raise the top page of the stack of paper 101 upward. When the top page of the stack of the paper 101 moves up to a certain height, a detector 106 outputs a detection signal. In response to the detection signal, the controller drives the motor 105 to stop.

A paper feeder 200 is located at an exit of the paper tray 100, and feeds the paper 101 on a page-by-page basis into a feeding section 300. The paper feeder 200 includes a pick-up roller 201, a feed roller 202, and a retard roller 203. When the stack of the paper 101 moves upward, the pick-up roller 201 contacts the top page of the paper 101. The feed roller 202 cooperates with the retard roller 203 to feed the paper 101 on a sheet-by-sheet basis into the paper feeding section 300. A paper detector 204 determines whether the paper 101 exists in the paper tray 100. A remaining paper detector 205 detects the amount of remaining paper 101 in the paper tray 100.

The paper feeder 200 separates the top page from the stack of paper 101 and feeds it into the paper feeding section 300. The paper 101 passes by a sensor 301 to a transport roller pair 302. The transport roller pair 302 is driven by a drive source, not shown, into rotation at a time after the paper 101 passes the sensor 301. Thus, the paper 101 is pushed into a nip defined between the transport roller pair 302 with some slack created in the paper 101, so that skew of the paper 101 is removed. The paper 101 further advances past a sensor 303 to a transport roller pair 304. When the paper 101 passes the sensor 303, a drive source, not shown, begins to drive the transport roller pair 304 into rotation, so that the paper 101 continues to be transported without stopping. The paper 101 then passes a write sensor 305 to an image forming section 430 for yellow.

Four toner image forming sections 430 are arranged in tandem. A transfer unit 460 transfers the toner images from the image forming sections onto the paper 101 by the Coulomb force in registration. The four image forming sections 430 have the same configuration except that they form yellow, magenta, cyan, and black images, respectively. For simplicity, only the operation of a yellow image forming section will be described, it being understood that others may work in a similar way.

A photoconductive drum 431 bears a toner image on it. A charging roller 432 charges the surface of the photoconductive drum 431. An LED head 433 illuminates the charged surface of the photoconductive drum 431 to form an electrostatic latent image on the photoconductive drum 431. A developing roller 434 supplies charged toner to the latent image to form a toner image on the photoconductive drum 431. A toner supplying section 436 supplies the toner to the developing roller 434. A cleaning blade 435 scrapes residual toner from the photoconductive drum 431 after transferring the toner image onto the paper 101.

A transfer belt 461 attracts the paper 101, and transports the paper 101. A drive source, not shown, drives a drive roller 462 to run a transfer belt 461. The transfer belt 461 is entrained about the drive roller 462 and a tension roller 463. A transfer roller 464 is disposed to hold the transfer belt 461 between the transfer roller 464 and the photoconductive drum 431 in sandwiched relation. A high voltage is applied to the transfer roller 464, so that the toner image is transferred onto the paper 101 by the Coulomb force. A cleaning blade 465 scrapes off the toner remaining on the transfer belt 461. The toner scraped off falls into a toner box 466.

The image forming sections 430 and the transfer belt 461 are driven in synchronism, so that the toner images of the respective colors are transferred onto the paper 101 carried on the transfer belt 461 one over the other in registration. The paper 101 is then advanced to a fixing unit 500 where the toner image on the paper 101 is fused into a full color permanent image by heat and pressure.

The fixing unit 500 includes an upper roller 501 and a lower roller 502 that are in pressure contact with each other. Each of the upper roller 501 and lower roller 502 includes a halogen lamp 503 that generates heat. As the paper 101 passes through a fixing region defined between the upper roller 501 and the lower roller 502, the toner image on the paper 101 is fused by heat and pressure into the full color permanent image. The paper 101 is then discharged by discharge roller pairs 504 onto a stacker 505.

Referring to the figures, an X-axis represents a direction in which the paper 101 advances through the respective image forming sections 430. A Y-axis represents a direction of rotational axis of the photoconductive drum 431. A Z-axis is a direction perpendicular to the X-axis and the Y-axis.

Figure 2:
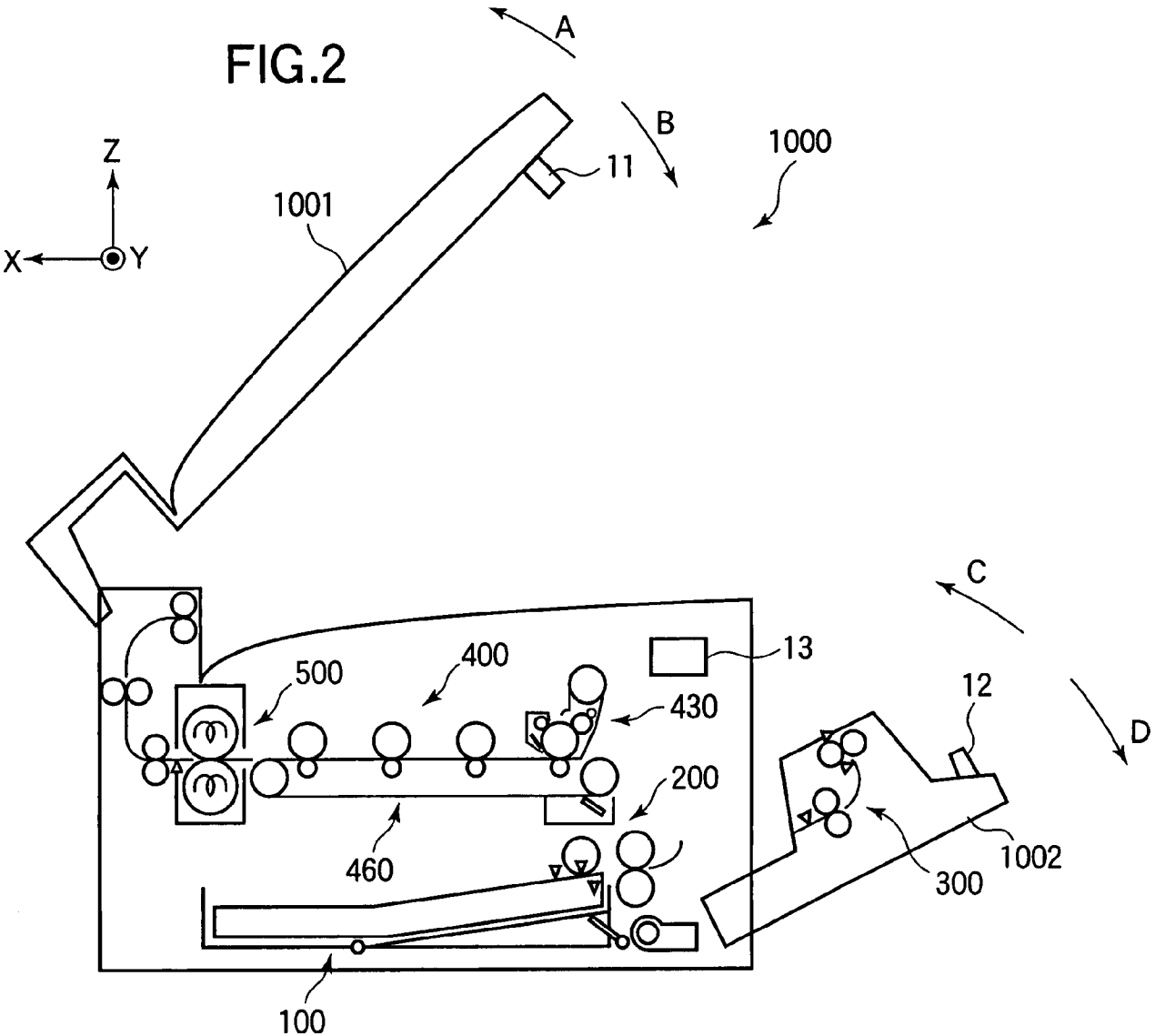
FIG. 2 is a side view of the image forming apparatus when a top cover and a side cover are opened.

FIG. 2 is a side view of the image forming apparatus 1000 when a top cover 1001 and a side cover 1002 are opened.

The image forming apparatus 1000 includes the top cover 1001 and the side cover 1002. Referring to FIG. 2, the top cover 1001 and side cover 1002 are mounted to a main body of the image forming apparatus, and are rotatable in directions shown by arrows A-D. The term "main body" covers the main portion of the image forming apparatus except detachable portions and movable portions such as the paper tray 100, top cover 1001, and side cover 1002. When the top cover 1001 and side cover 1002 are opened, the interior of the image forming apparatus 1000 can be observed and accessible to the operator so that the toner image forming section 430, transfer section 460, and fixing unit 500 may be replaced. The LED head 433 (FIG. 1), not shown in FIG. 2, is mounted to the top cover 1001. The paper feeding section 300 is assembled to the side cover 1002. The top cover 1001 and/or side cover 1002 may be opened to remove paper jammed or broken in the paper transport path.

A projection 11 projects from the top cover 1001 and a projection 12 projects from the side cover 1002. A detector 13 is provided on the main body of the image forming apparatus. The detector 13 detects the positions of the projections 11 and 12 to determine whether the top cover 1001 and the side cover 1002 are open. The projections 11 and 12 and the detector 13 form a detecting mechanism 10. In response to the detection output of the detecting mechanism 10, power supply to the image forming apparatus is shut off until the top cover 1001 and the side cover 1002 are completely closed.

Figure 3A:
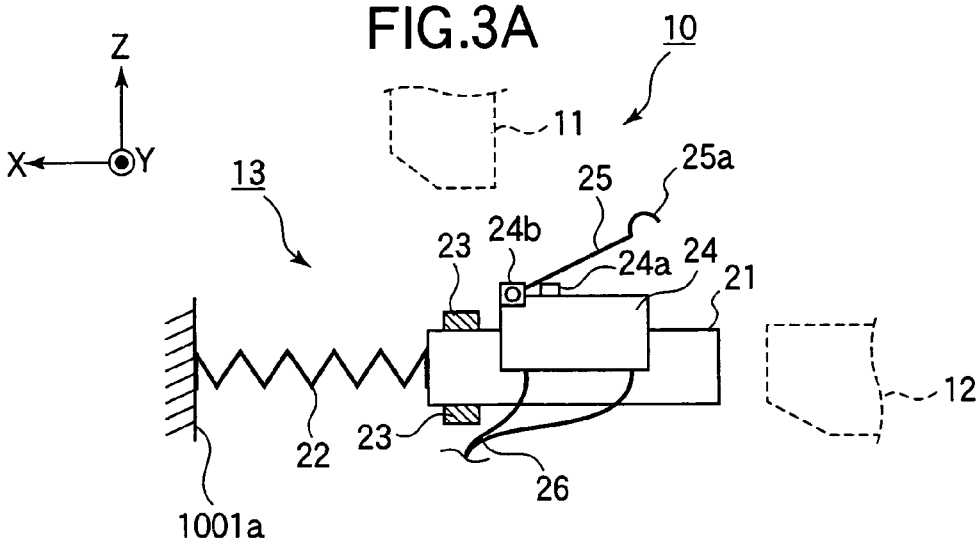
FIGS. 3A-3C illustrate the configuration of a detecting mechanism and the corresponding operation.
Figure 3B:
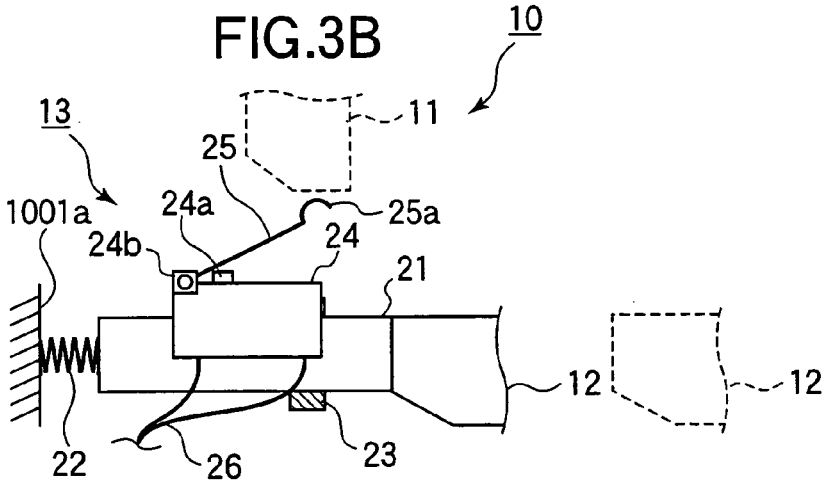
Figure 3C:
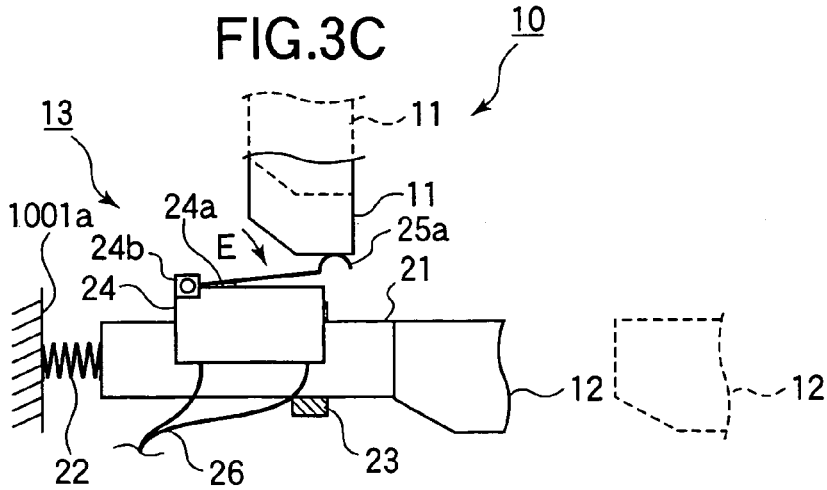

FIGS. 3A-3C illustrate a configuration of the detecting mechanism 10 (FIG. 1) and the corresponding operation.

Referring to FIG. 3A, the detector 13 includes a switch holder 21, a micro switch 24, a hinge lever 25, a compression spring 22, and a guide 23. The switch holder 21 holds the micro switch 24 thereon, and is guided by the guide 23 to move toward and away from a chassis 1001*a* (X-direction). The compression spring 22 urges the switch holder 21 away from the chassis 1001*a* of the apparatus (X-direction). The switch holder 21 is restricted by a stopper, not shown, from moving further away from the chassis 1001*a* (i.e., beyond the position in FIG. 3A). The hinge lever 25 can pivot about its one end coupled to an axis 24*b* on the micro switch 24. The hinge lever 25 pivots toward the micro switch 24 to depress a switch button 24*a* to make the micro switch 24 ON, and away from the micro switch 24 to release the switch button 24*a* to make the micro switch 24 OFF. The ON/OFF states of the micro switch 24 are transmitted to a circuit, not shown, via leads 26. The switch button 24*a* is a non-lock type that makes the micro switch 24 ON only when it is depressed by the hinge lever 25. The hinge lever 25 is capable of moving back to a position where the micro switch 24 returns to its OFF state when the force is removed from the hinge lever 25.

The projections 11 and 12 are at their opening positions where the top cover 1001 and side cover 1002 are completely or partially open and therefore the detector 13 does not detect the projections 11 and 12.

FIGS. 3A-3C illustrate the opening positions of the top cover 1001 and side cover 1002 in dotted lines.

{Side Cover First Closed and then Top Cover Closed}

The operation of the detecting mechanism 10 will be described where the side cover 1002 is first closed and then the top cover 1001 is closed. The operation will be described with reference to FIGS. 3A-3C.

FIG. 3A illustrates the detector 10 when the top cover 1001 and side cover 1002 are open. When the side cover 1002 is closed from the position in FIG. 3A, the projection 12 moves from the opening position (dotted lines) in FIG. 3A to a closing position (solid lines) in FIG. 3B. The projection 12 pushes the switch holder 21 to slide toward the chassis 1001*a* against the urging force of the compression spring 22. At this moment, as shown in FIG. 3B, the micro switch 24 takes up a position where the tip portion 25*a* of the hinge lever 25 can engage the projection 11.

When the top cover 1001 is closed, the projection 11 moves from the opening position (dotted lines) in FIG. 3B to the closing position (solid lines) in FIG. 3C. At this moment, the projection 11 takes up a position where the projection 11 pushes the tip portion 25*a* of the hinge lever 25, causing the hinge lever 25 to pivot in a direction shown by arrow E (toward the micro switch 24). The hinge lever 25 depresses the switch button 24*a* to make the micro switch 24 ON.

As described above, upon detecting when the micro switch 24 shifts from the ON state to the OFF state, the detector 13 determines that both the top cover 1001 and side cover 1002 have been completely closed, and then notifies a control means, not shown, of the closing of the top cover 1001 and side cover 1002.

{Top Cover First Closed and then Side Cover Closed}

Another operation of the detecting mechanism 10 will be described where the top cover 1001 is first closed and then the side cover 1002 is closed. The operation will be described with reference to FIGS. 4A-4C.

Figure 4A:
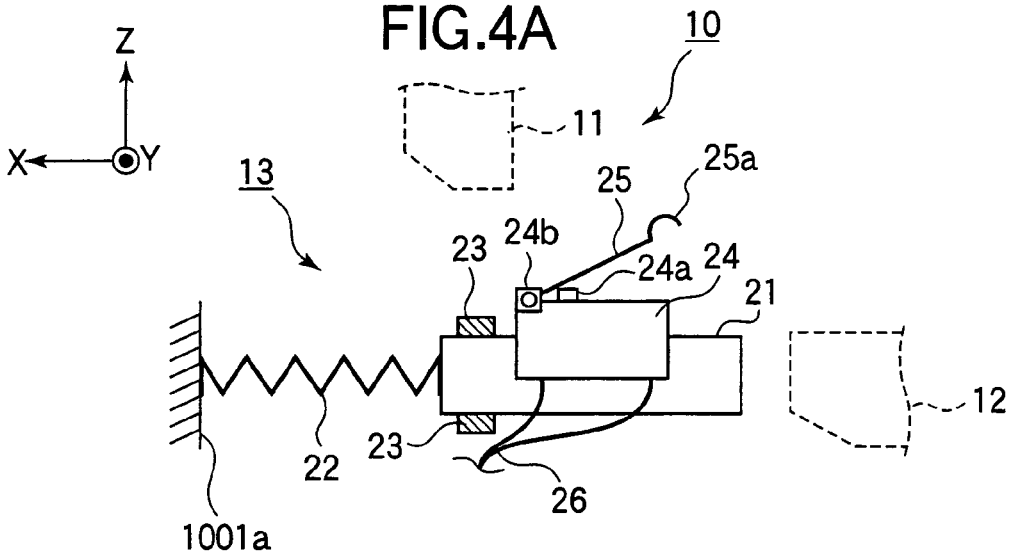
FIGS. 4A-4C illustrate the configuration of the detecting mechanism and the corresponding operation.
Figure 4B:
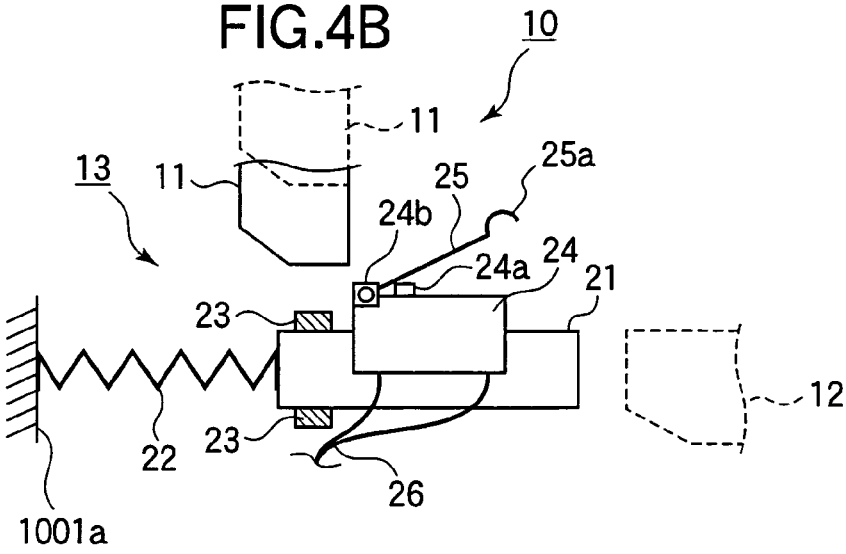
Figure 4C:
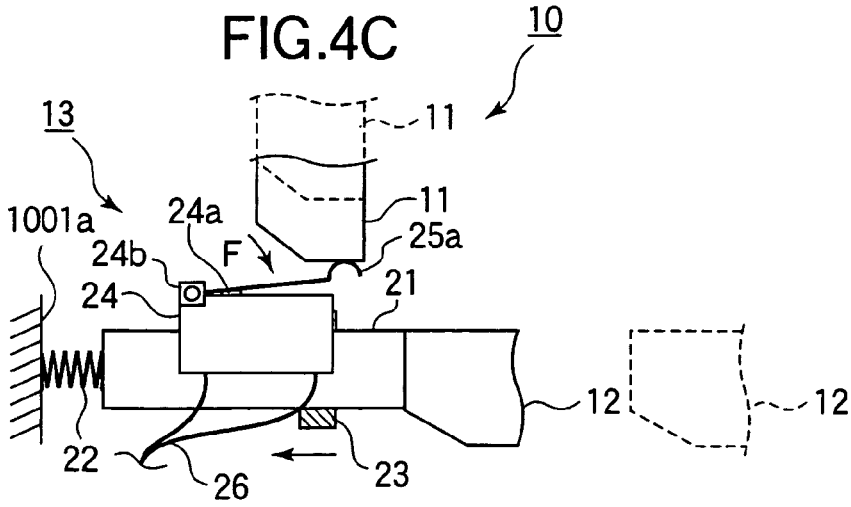

FIGS. 4A-4C illustrate the configuration of the detecting mechanism 10 and the corresponding operation. FIG. 4A illustrates the detector 10 when the top cover 1001 and side cover 1002 are open.

When the top cover 1001 is closed from the position in FIG. 4A, the projection 11 moves from the opening position (dotted lines) in FIG. 4A to a closing position (solid lines) in FIG. 4B. As is clear from FIG. 4B, the projection 11 does not act on any structural element.

When the side cover 1002 is closed subsequently, the projection 12 moves from the opening position to a closing position as shown in FIG. 4C. At this moment, the projection 12 causes the switch holder 21 to move toward the chassis 1001*a* against the urging force of the compression spring 22. As the switch holder 21 moves toward the chassis 1001*a*, the tip portion 25*a* of the hinge lever 25 is pushed by the projection 11 to pivot in a direction shown by arrow F (clockwise about the axis 24*b*), depressing the switch button 24*a* to make the micro switch 24 ON.

As described above, upon detecting when the micro switch 24 shifts from the OFF state to the ON state, the detector 13 determines that both the top cover 1001 and side cover 1002 have been completely closed, and then notifies a control means, not shown, of the closing of the top cover 1001 and side cover 1002.

{At Least One of Top Cover and Side Cover Opened}

The operation will be described in which the detecting mechanism detects that at least one of the top cover 1001 and the side cover 1002 is opened.

Referring to FIG. 4C, the top cover 1001 and the side cover 1002 are closed. As the side cover 1002 is opened, the projection 12 moves from the closing position (solid lines) in FIG. 4C to the opening position (dotted lines) in FIG. 4B, allowing the urging force of the compression spring 22 to move the switch holder 21 away from the chassis 1001*a* to the position in FIG. 4B where the switch holder 21 is restricted by a stopper, not shown, from moving any further. This movement of the switch holder 21 sets the hinge lever 25 free, which in turn brings the switch button 24*a* into the OFF state. As described above, detecting when the micro switch 24 shifts from the ON state to the OFF state, the detector 13 determines that at least one of the top cover 1001 and the side cover 1002 is opened, and then notifies a controlling means, not shown, of the opening of the side cover 1002.

Referring to FIG. 4C, the top cover 1001 and the side cover 1002 are closed. When the top cover 1001 is opened, the projection 11 moves from the closing position (solid lines) in FIG. 4C to the opening position (dotted lines) in FIG. 4C, allowing the hinge lever 25 to bring the switch button 24*a* out of the ON state into the OFF state. As described above, upon detecting when the micro switch 24 shifts from the ON state to the OFF state, the detector 13 determines that at least one of the top cover 1001 and the side cover 1002 is opened, and then notifies the controlling means of the opening of the top cover 1001 and side cover 1002.

As described above, the micro switch 24 of the detecting mechanism 10 becomes OFF when at least one of the top cover 1001 and the side cover 1002 is opened, and ON only when both the top cover 1001 and the side cover 1002 are closed.

The use of only one detector such as a micro switch allows detection of whether at least one of the two covers is opened, and eliminates the need for a plurality of switches and hardware for checking the detection results of the plurality of switches. The first embodiment simplifies the overall configuration, reducing the number of parts for cost reduction as well as improving reliability of the detecting mechanism.

Second Embodiment

Figure 5A:
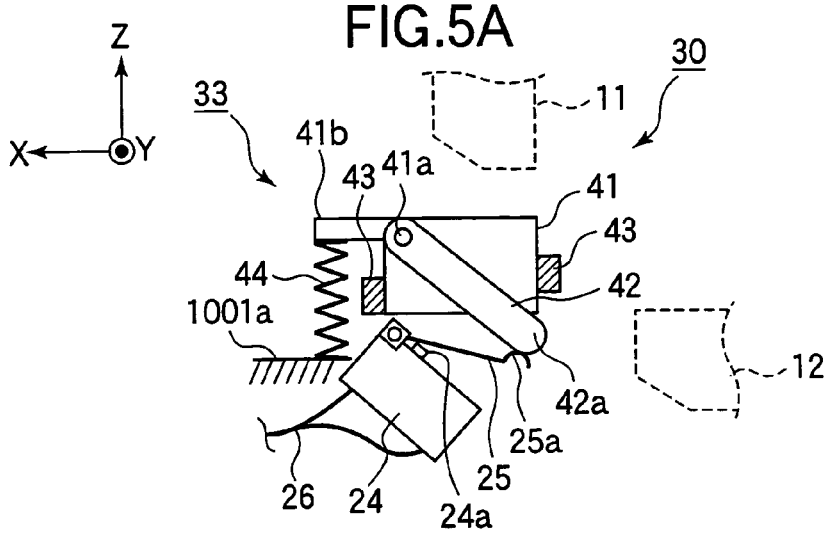
FIGS. 5A-5C illustrate the configuration of a detecting mechanism of a second embodiment and its operation.
Figure 5B:
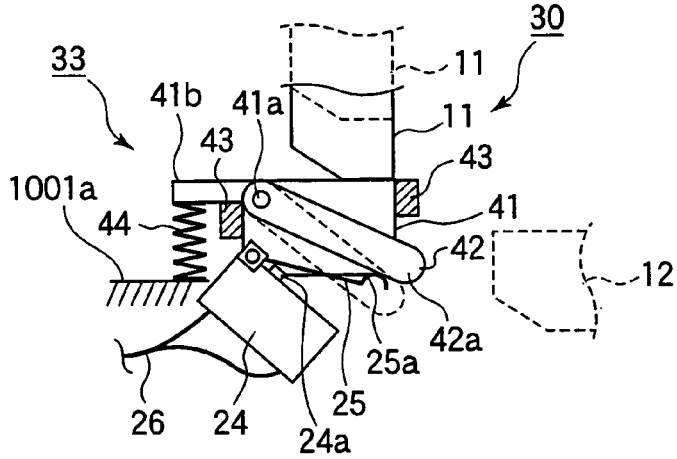
Figure 5C:
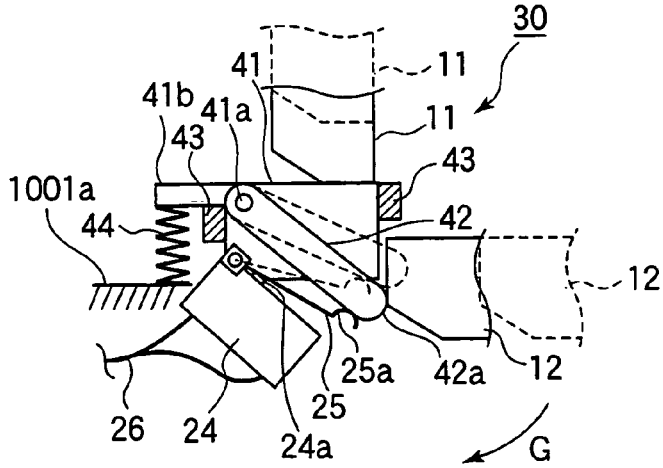

FIGS. 5A-5C illustrate the configuration of a detecting mechanism 30 of a second embodiment and its operation.

The detecting mechanism 30 differs from the detecting mechanism 10 (FIGS. 3 and 4) in the configuration of a detector 33. Elements similar to those in the first embodiment have been given the same reference numerals, and their description is omitted. The description will be given only of a portion different from the first embodiment.

Referring to FIG. 5A, the detector 33 is provided on the main body of the image forming apparatus. The detector 33 includes a bar holder 41, a guide 43, a micro switch 24, a hinge lever 25, and a compression spring 44. The bar holder 41 includes a shaft 41*a* about which one end portion of a bar 42 pivots, and is guided by guides 43 to slide toward and away from a chassis 1001*a* (X-direction). The bar holder 41 is urged by the compression spring 44 such that the bar holder 41 slides away from the chassis 1001*a* (Z-direction) to a position in FIG. 5A where the bar holder 41 is restricted by a stopper, not shown, from moving any further. The micro switch 24 is disposed at a location where the micro switch 24 does not interfere with the bar holder 41 when the bar holder 41 moves toward and away from a chassis 1001*a* (Z-direction).

The weight of the bar 42 causes the tip of the bar 42 to abut the tip portion 25*a* of the hinge lever 25. One end of the hinge lever 25 is pivotally coupled to the micro switch 24. The micro switch 24 becomes ON or OFF depending on the angular position of the hinge lever 25 with respect to the micro switch 24. The ON and OFF states of the micro switch 24 are transmitted to a circuit, not shown, via leads 26. The bar 42 is formed of a light material such as plastics, so that the weight of the bar 42 is not large enough to depress the switch button 24*a* to make the micro switch 24 ON.

A projection 11 is formed on the top cover 1001 and a projection 12 is formed on the side cover 1002. When the top cover 1001 and side cover 1002 are completely or partially opened, projections 11 and 12 are at their opening positions where projections 11 and 12 do not engage the detector 33.

{Top Cover First Closed and then Side Cover Closed}

The operation of the detecting mechanism 30 of the aforementioned configuration will be described in which the top cover 1001 is first closed and then the side cover 1002 is closed.

Referring to FIG. 5A, the top cover 1001 and side cover 1002 are completely open so that the projections 11 and 12 are at their opening positions.

Referring to FIG. 5B, as the top cover 1001 is closed, the projection 11 moves from the opening position (dotted lines)

in FIG. 5A to a closing position (solid lines) in FIG. 5B. At this moment, the projection 11 causes the bar holder 41 to move toward the chassis 1001*a* against the urging force of the compression spring 44. Thus, the bar 42 pivots about a pin 41*a* from a dotted line position to a solid line position, a tip portion 42*a* of the bar 42 continuing to rest on the tip 25*a* of the hinge lever 25 but not causing the hinge lever 25 to make the micro switch ON.

Referring to FIG. 5C, as the side cover 1002 is closed subsequently, the projection 12 moves from the opening position (dotted lines) in FIG. 5B to the closing position (solid line position) in FIG. 5C. At this moment, the projection 12 acts on the tip portion 42*a* of the bar 42 to cause the bar 42 to pivot in a direction shown by arrow G. As a result, the bar 42 acts on the hinge lever 25, causing the hinge lever 25 to pivot in the G direction. The hinge lever 25 depresses the switch button 24*a*, making the micro switch ON.

Upon detecting when the micro switch 24 shifts from the OFF state to the ON state, the detecting mechanism 33 determines that the top cover 1001 and the side cover 1002 have been completely closed, and then notifies a control means, not shown, of the closing of the top cover 1001 and side cover 1002.

{Side Cover First Closed and then Top Cover Close}

The operation of the detecting mechanism 30 will be described where the side cover 1002 is first closed and then the top cover 1001 is closed. The operation will be described with reference to FIGS. 6A-6C.

Figure 6A:
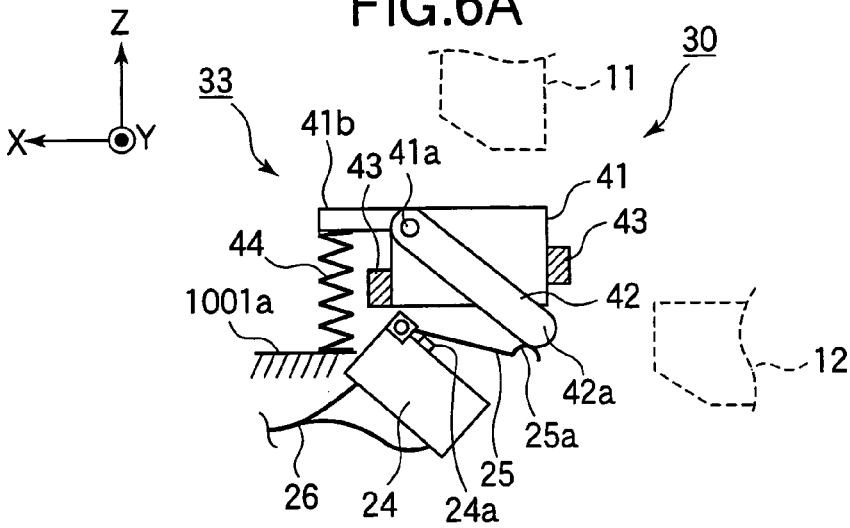
FIGS. 6A-6C illustrate the operation when the side cover is first closed and then the top cover is closed.
Figure 6B:
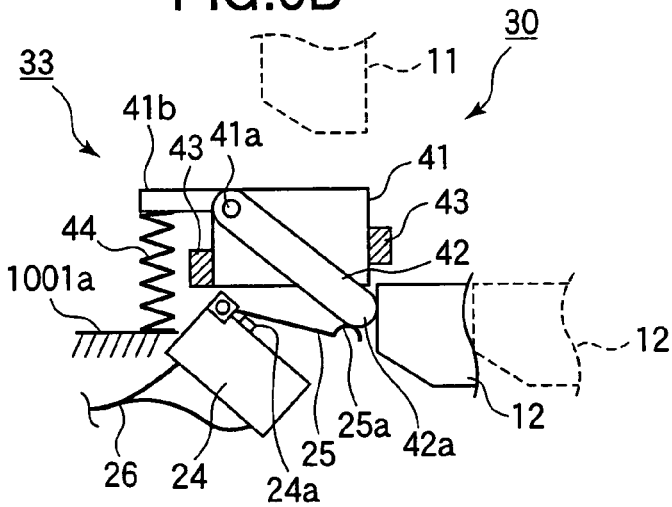
Figure 6C:
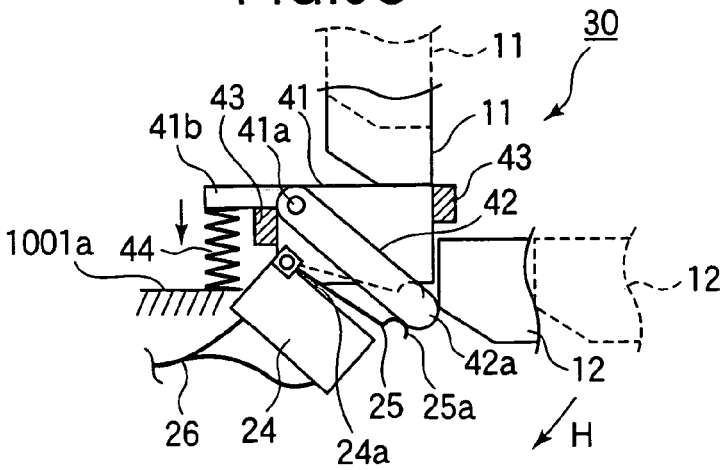

FIGS. 6A-6C illustrate the operation when the side cover 1002 is first closed and then the top cover 1001 is closed.

Referring to FIG. 6A, the top cover 1001 and side cover 1002 are completely open so that the projections 11 and 12 are at their opening positions.

As the side cover 1002 is closed, the projection 12 moves from the opening position (dotted lines) in FIG. 6A to the closing position (solid lines) in FIG. 6B. At this moment, the projection 12 merely contacts the tip portion 42*a* of the bar 42.

As the top cover 1001 is closed, the projection 11 moves from the opening position (dotted lines) in FIG. 6B to the closing position (solid lines) in FIG. 6C. At this moment, the projection 11 causes the bar holder 41 to move toward the chassis 1001*a* against the urging force of the compression spring 44, so that the bar 42 also moves toward the chassis 10001*a*, causing the hinge lever 25 to pivot in a direction shown by arrow H from the dotted line position to the solid line position in FIG. 6C. Therefore, the hinge lever 25 depresses the switch button 24*a* to make the micro switch 24 ON.

Upon detecting when the micro switch 24 shifts from the OFF state to the ON state, the detecting mechanism 33 determines that the top cover 1001 and the side cover 1002 have been completely closed, and then notifies a control means, not shown, of the closing of the top cover 1001 and side cover 1002.

{At Least One of Top Cover and Side Cover Opened}

The operation will be described in which the detecting mechanism detects that at least one of the top cover 1001 and the side cover 1002 is opened.

Referring to FIG. 5C, the top cover 1001 and side cover 1002 are completely closed so that the projections 11 and 12 are at their closing position. As the side cover 1002 is opened, the projection 12 moves from the closing position (solid lines) in FIG. 5C to the opening position (dotted lines) in FIG. 5B. This movement of the projection 12 sets the bar 42 and the hinge lever 25 free, allowing the hinge lever 25 to move out of pressing engagement with the switch button 24*a*. Thus, the micro switch becomes OFF. As described above, upon detecting when the micro switch 24 shifts from the ON state to the OFF state, the detector 33 determines that at least one of the top cover 1001 and the side cover 1002 is opened, and then notifies a controlling means, not shown, of the opening of the top cover 1001 and side cover 1002.

Referring to FIG. 6C, the top cover 1001 and side cover 1002 are completely closed so that the projections 11 and 12 are at their closing positions. As the top cover 1001 is opened, the projection 11 moves from the closing position in (solid lines) in FIG. 6C to the opening position (dotted lines) in FIG. 6B. This movement of the projection 11 allows the bar holder 41 urged by the compression spring 44 to move away from the chassis 1001*a* (Z-direction). The bar holder 41 moves to a position in FIG. 6B where the bar holder 41 is restricted by a stopper, not shown, from moving further away from the chassis 1001*a*. The hinge lever 25 returns to the position at which only the small weight of the bar 42 acts on the hinge lever 25. Thus, the hinge lever 25 no longer depresses the switch button 24*a*. The micro switch becomes OFF accordingly. As described above, upon detecting when the micro switch 24 shifts from the ON state to the OFF state, the detector 33 determines that at least one of the top cover 1001 and the side cover 1002 is opened, and then notifies a controlling means, not shown, of the opening of the top cover 1001 and side cover 1002.

As described above, the micro switch 24 of the detecting mechanism 30 becomes OFF when at least one of the top cover 1001 and the side cover 1002 is opened, and ON only when both the top cover 1001 and the side cover 1002 are closed.

The use of only one detector such as a micro switch allows detection of whether at least one of the two covers is opened, and eliminates the need for a plurality of switches and hardware for checking the detection results of the plurality of switches. This configuration simplifies the overall configuration, reducing the number of parts for cost reduction as well as improving reliability of the apparatus. In addition, fixing the micro switch to the main body of the apparatus would solve problems such as cutting off of leads connected to the micro switch and interference of leads against the movement of the micro switch that would occur if the micro switch is not stationary.

Third Embodiment

FIGS. 7-14 illustrate the configuration and operation of a detecting mechanism 50 of a third embodiment.

The detecting mechanism 50 differs from the detecting mechanism 10 of the first embodiment in the configuration of a detector 53. Elements similar to those in the first embodiment have been given the same reference numerals and their description is omitted. The description will be given only of portions different from the first embodiment.

Figure 7:
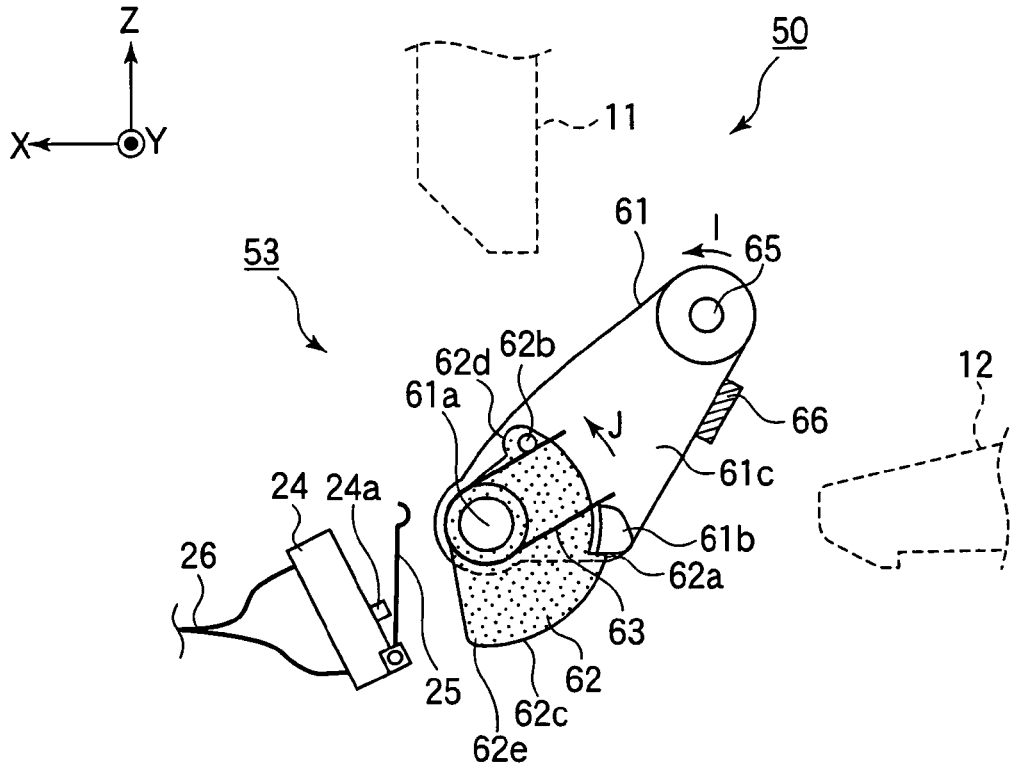
FIGS. 7-10 and FIGS. 11-14 illustrate the configuration and operation of a detecting mechanism of a third embodiment.

Referring to FIG. 7, the detector 53 includes a cam holder 61, a micro switch 24 and a hinge lever 25, a cam 62, and a torsion spring 63. A slidable member may alternatively be used in place of the rotatable cam holder 61. The cam holder 61 is rotatably supported on a shaft 65 that extends in a direction perpendicular to the paper (Y-direction), and includes a shaft 61*a* that extends in a direction perpendicular to the paper (Y-direction). The cam holder 61 is formed with an engagement portion 61*b* that abuts a stepped portion 62*a* of the cam 62 and a projection 12 on the side cover 1002. The shaft 61*a* extends through the torsion spring 63. The cam 62 is rotatably supported on the shaft 61*a*. The torsion spring 63 is held at its one end by an engagement pin 62*b* formed on the cam 62 and at its another end by an engagement portion 61*b* of the cam holder 61. The torsion spring 63 urges the cam 62 against the cam holder 61 in a direction shown by an arrow J.

The engagement portion 61*b* of the cam holder 61 abuts the stepped portion 62*a* of the cam, preventing the cam 62 from rotating counterclockwise beyond the engagement portion 61*b*. The position of the cam 62 relative to the cam holder 61 is assumed to be a holder home position in this specification. The micro switch 24 is positioned such that when the cam 62 rotates about the shaft 61*a* in a direction shown by arrow L (FIG. 9), a corner 62*e* (i.e., end of a circumferential edge 62*c*) of the cam 62 causes the hinge lever 25 to depress the micro switch 24.

When the cam holder 61 rotates in a direction shown by arrow I, a stopper 66 abuts the cam holder 61 to prevent the cam holder 61 from rotating further. The position of the cam 62 with respect to the cam holder 61 in FIG. 7 is assumed to be a cam home position of the cam holder 61.

In this specification, it is said that the projections 11 and 12 are at their opening positions where the top cover 1001 and side cover 1002 are completely or partially open and therefore the detector 53 does not detect the projections 11 and 12. FIGS. 7-10 and 11-14 show the opening positions of the projections 11 and 12 in dotted lines. When the projection 11 moves toward the detecting mechanism 50, the projection 11 does not push the cam holder 61, but pushes the engagement pin 62*b* of the cam 62. When the projection 12 moves toward the detection mechanism 50, the projection 12 pushes the engagement portion 61*b* of the cam holder 61.

{Side Cover First Closed and then Top Cover Closed}

The operation of the detecting mechanism 50 of the aforementioned configuration will be described.

FIG. 7 illustrates when the projections 11 and 12 are at their opening positions (dotted line). The operation of the detecting mechanism 50 will be described where the side cover 1002 is first closed and then the top cover 1001 is closed. The operation will be described with reference to FIGS. 7-10.

FIG. 7 illustrates the projections 11 and 12 at their opening positions. As the side cover 1002 is closed, the projection 12 moves from the opening position (dotted lines) in FIG. 7 to the closing position (solid lines) in FIG. 8. The projection 12 abuts the cam holder 61 and then pushes the cam holder 61 to slightly rotate clockwise in a direction shown by arrow K. At this moment, the corner 62*e* of the cam 62 moves into engagement with the mid portion of the hinge lever 25 but does not cause the hinge lever 25 to make the micro switch 24 ON.

Figure 9:
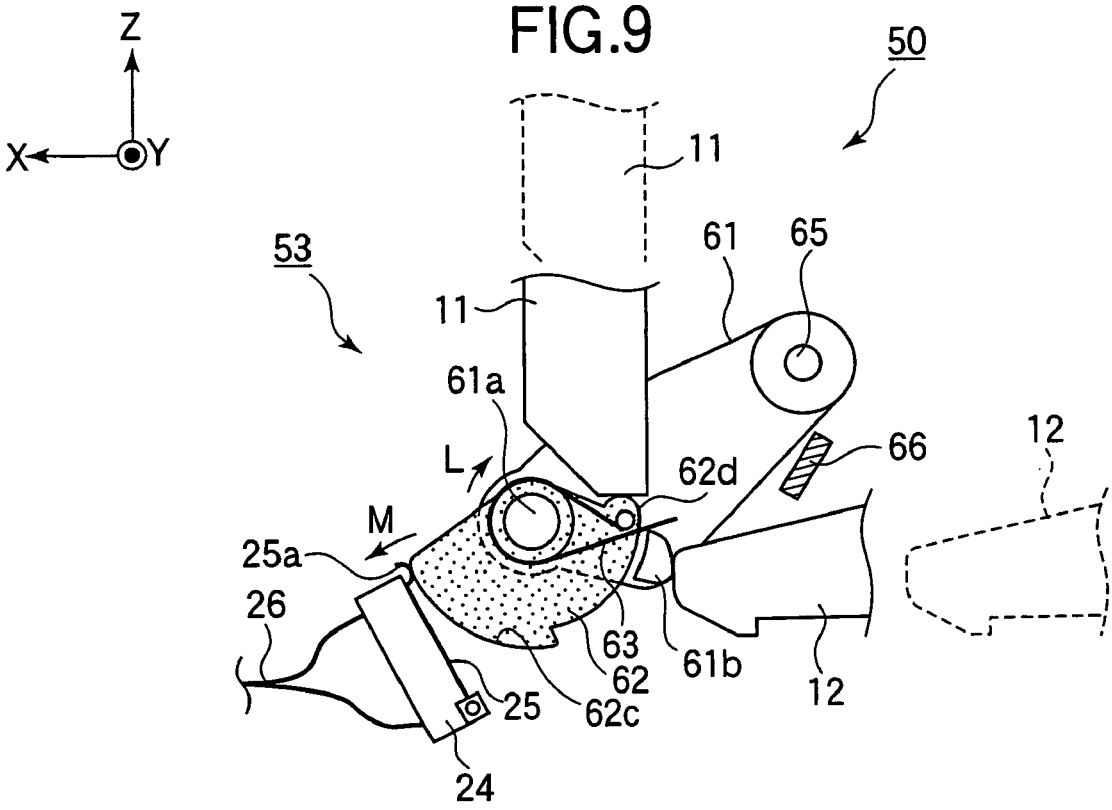

FIG. 9 illustrates the projections 11 and 12 at their closing positions. Referring to FIG. 9, as the top cover 1001 is closed, the projection 11 moves from the opening position (dotted lines) in FIG. 7 to the closing position (solid lines) in FIG. 9. The projection 11 pushes the projection 62*d* of the cam 62, causing the cam 62 to rotate against the urging force of the torsion spring 63 from the cam home position in a direction shown by arrow L (clockwise). The rotation of the cam 62 causes the hinge lever 25 to pivot in the direction shown by arrow M. Thus, as shown in FIG. 9, the hinge lever 25 depresses the switch button 24*a* of the micro switch 24 to make the micro switch 24 ON.

As described above, upon detecting when the micro switch 24 shifts from the OFF state to the ON state, the detector 53 determines that the top cover 1001 and side cover 1002 have been completely closed, and then notifies a control means, not shown, of the closing of the top cover 1001 and side cover 1002.

Figure 10:
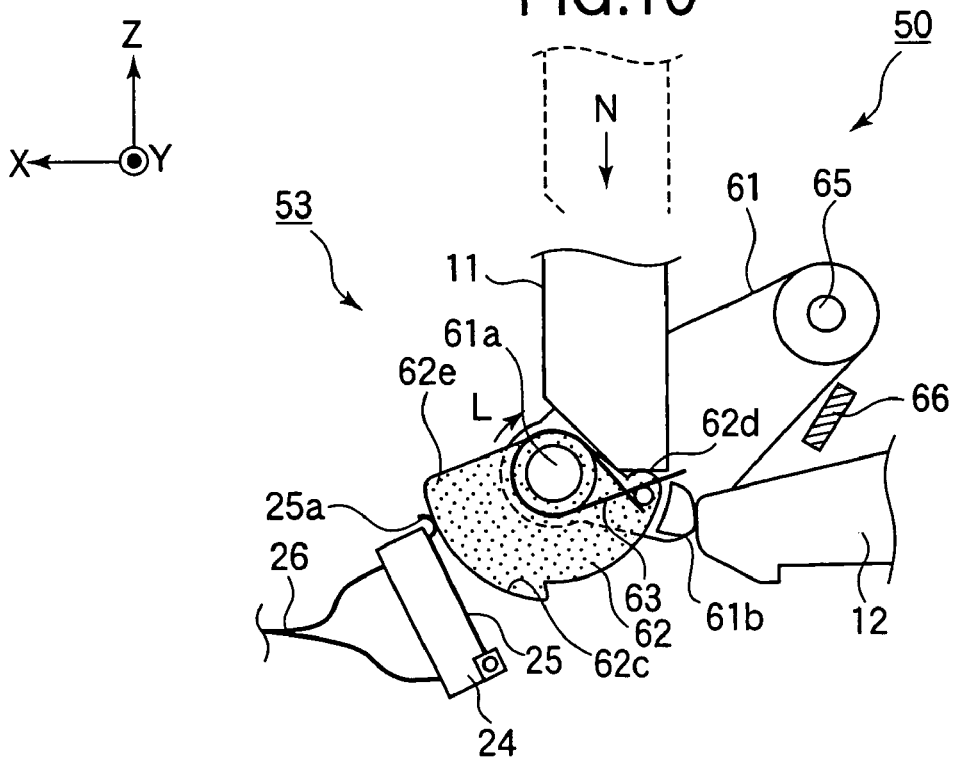

If the top cover 1001 is pushed into the apparatus farther than the closing position, the projection 11 moves further in a direction shown by arrow N in FIG. 10, causing the cam 62 to rotate further in the direction shown by arrow L. However, because the radius of the circumferential portion 62*c* is constant with respect to a rotational axis of the cam 62, the circumferential portion 62*c* slides on the tip portion 25*a* of the hinge lever 25 but will not depress the hinge lever 25 any further.

{Top Cover First Closed and then Side Cover Closed}

The operation will be described where the top cover 1001 is first closed and then the side cover 1002 is closed. The operation will be described with respect to FIGS. 11-14.

Figure 11:
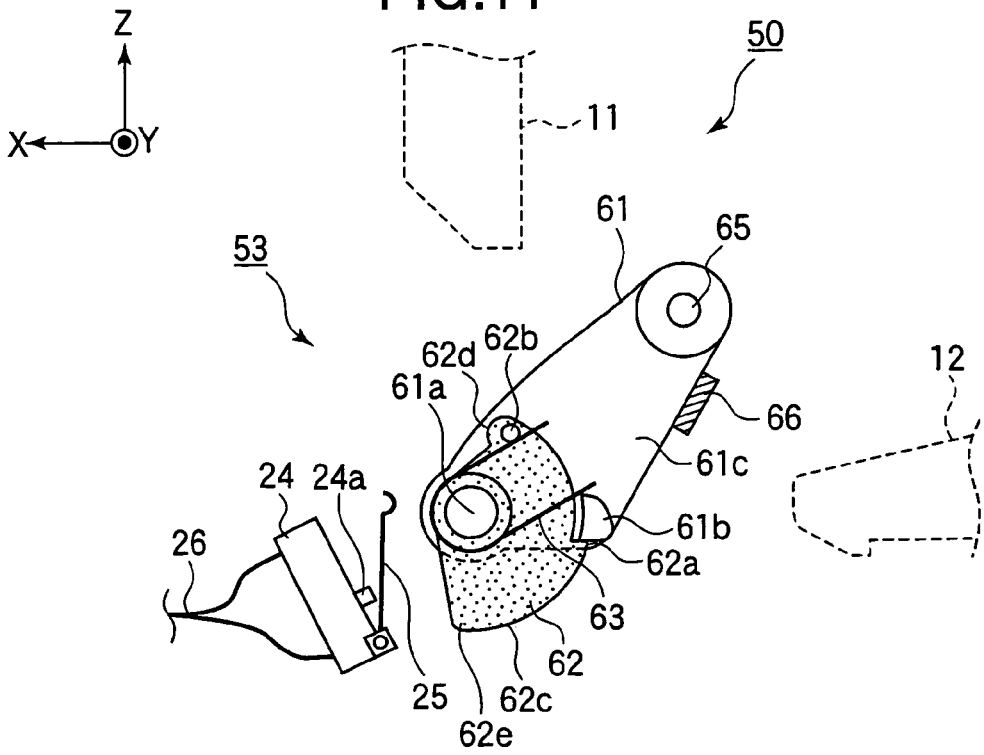
Figure 12:
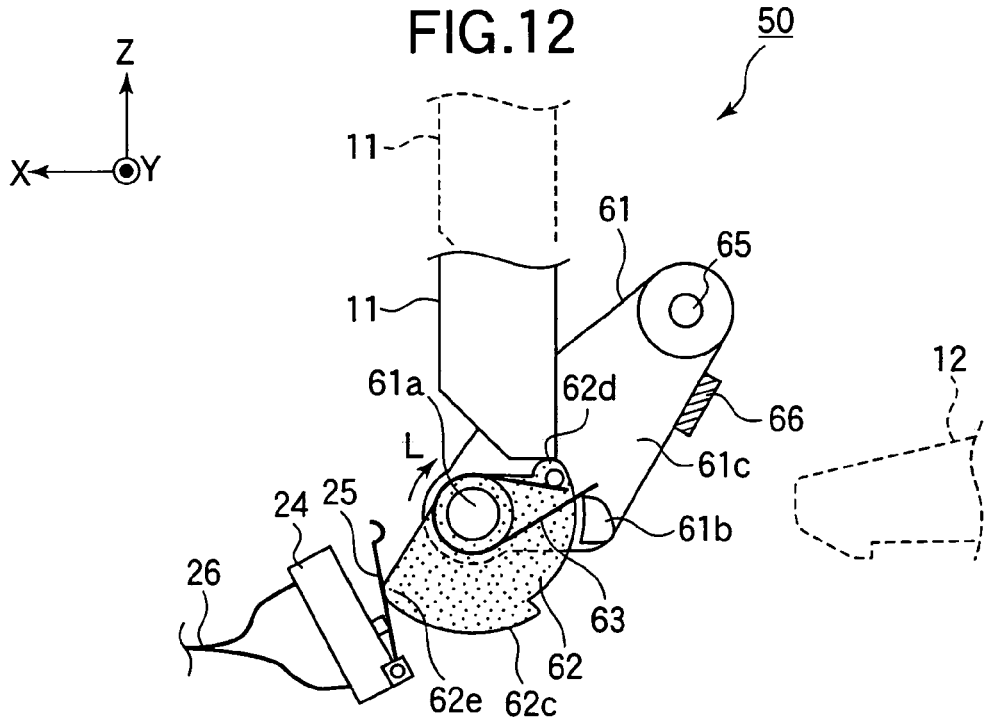

FIG. 11 illustrates the projections 11 and 12 when they are at their opening positions. As the top cover 1001 is closed, the projection 11 moves from the opening position (dotted lines) in FIG. 11 to the closing position (solid lines) in FIG. 12. At this moment, the projection 11 pushes the projection 62*d* of the cam 62, causing the cam 62 to rotate in the L direction against the urging force of the torsion spring 63 from the cam home position. At this moment, as shown in FIG. 12, an end of the circumferential portion 62*c* of the cam 62 moves into engagement with the mid portion of the hinge lever 25 but does not cause the hinge lever 25 to make the micro switch 24 ON.

As the side cover 1002 is closed subsequently, the projection 12 moves from the opening position (dotted lines) in FIG. 12 to the closing position (solid line position) in FIG. 13. At this moment, the projection 12 acts on the engagement portion 61*b* of the cam holder 61, causing the cam holder 61 to pivot in a direction of arrow K. As a result, the shaft 61*a* also rotates in the same direction. Because the projection 11 abuts the projection 62*d*, the cam 62 rotates about the shaft 61*a* in the direction shown by arrow L (clockwise), causing the hinge lever 25 to pivot counterclockwise in a direction shown by arrow R. Thus, the hinge lever 25 depresses the switch button 24*a*, making the micro switch ON.

As described above, upon detecting when the micro switch 24 shifts from the OFF state to the ON state, the detector 53 determines that the top cover 1001 and side cover 1002 have been completely closed, and then notifies a control means, not shown, of the closing of the top cover 1001 and side cover 1002.

Figure 14:
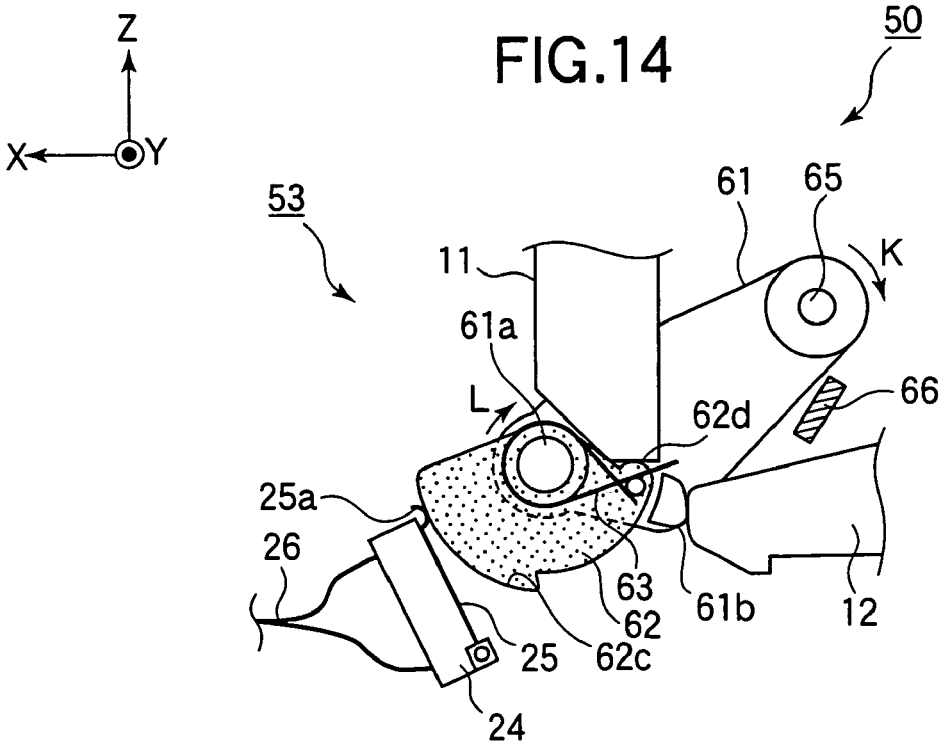

If the side cover 1002 is pushed into the apparatus further than the closing position, the projection 12 moves further as shown in FIG. 14, causing the cam 62 to rotate further in the direction shown by arrow L. However, because the radius of the circumferential portion 62*c* is constant with respect to a rotational axis (i.e., shaft 61*a*) of the cam 62, the circumferential portion 62*c* slides on the tip portion 25*a* of the hinge lever 25 but will not depress the hinge lever 25 any further.

{One of Top Cover and Side Cover Opened}

The operation will be described in which one of the top cover 1001 and the side cover 1002 is opened.

Figure 13:
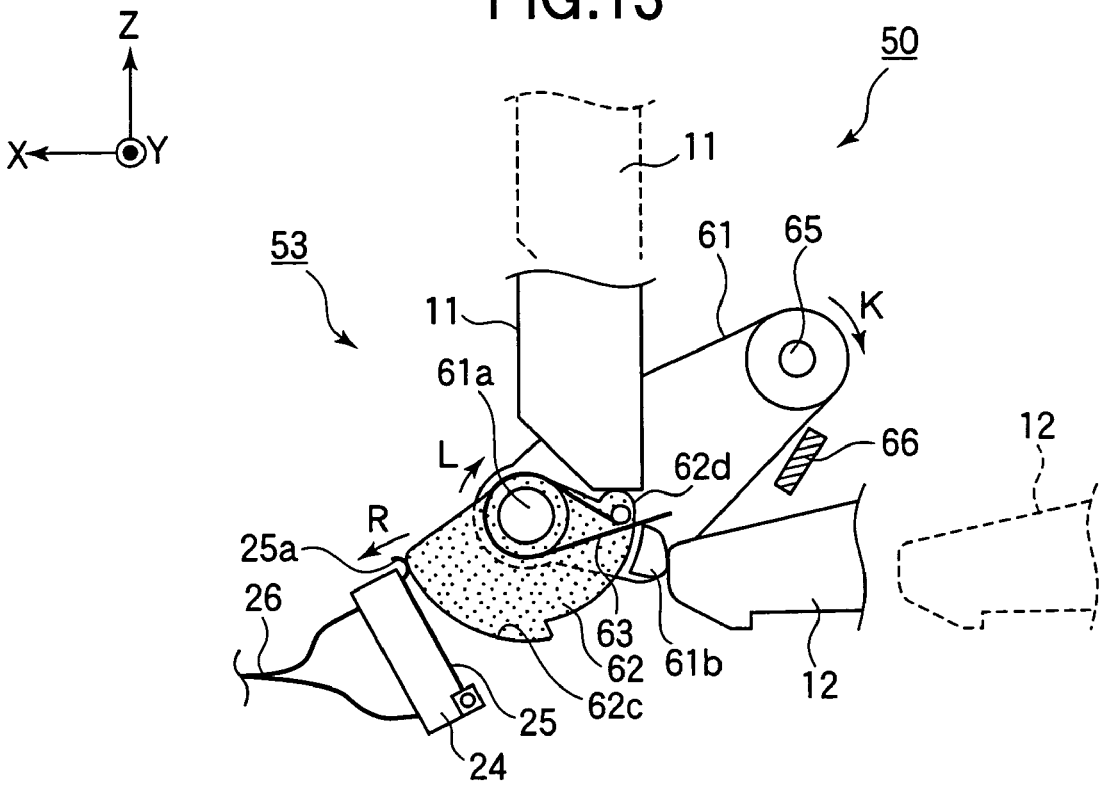

Referring to FIG. 13, the top cover 1001 and side cover 1002 are completely closed so that the projections 11 and 12 are at their closing positions. As the side cover 1002 is opened, the projection 12 moves from the closing position (solid lines) in FIG. 13 to the opening position (dotted lines) in FIG. 12. At this moment, the urging force of the torsion spring 63 causes the cam holder 61 to return to the holder home position in FIG. 12, and the cam holder 61 rotates slightly counterclockwise due to the urging force of the torsion spring 63, allowing the hinge lever 25 to make the micro switch 24 OFF. Because the projection 11 remains at the closing position, the projection 11 continues to abut the projection 62*d* of the cam 62, preventing the cam 62*d* from rotating any further. As a result, the cam 62 still presses the hinge lever 25 slightly but no longer causes the hinge lever 25 to make the micro switch 24 ON. As described above, upon detecting when the micro switch 24 shifts from the ON state to the OFF state, the detector 53 determines that at least one of the top cover 1001 and side cover 1002 have been completely closed, and then notifies a control means, not shown, of the closing of the top cover 1001 and side cover 1002.

Figure 8:
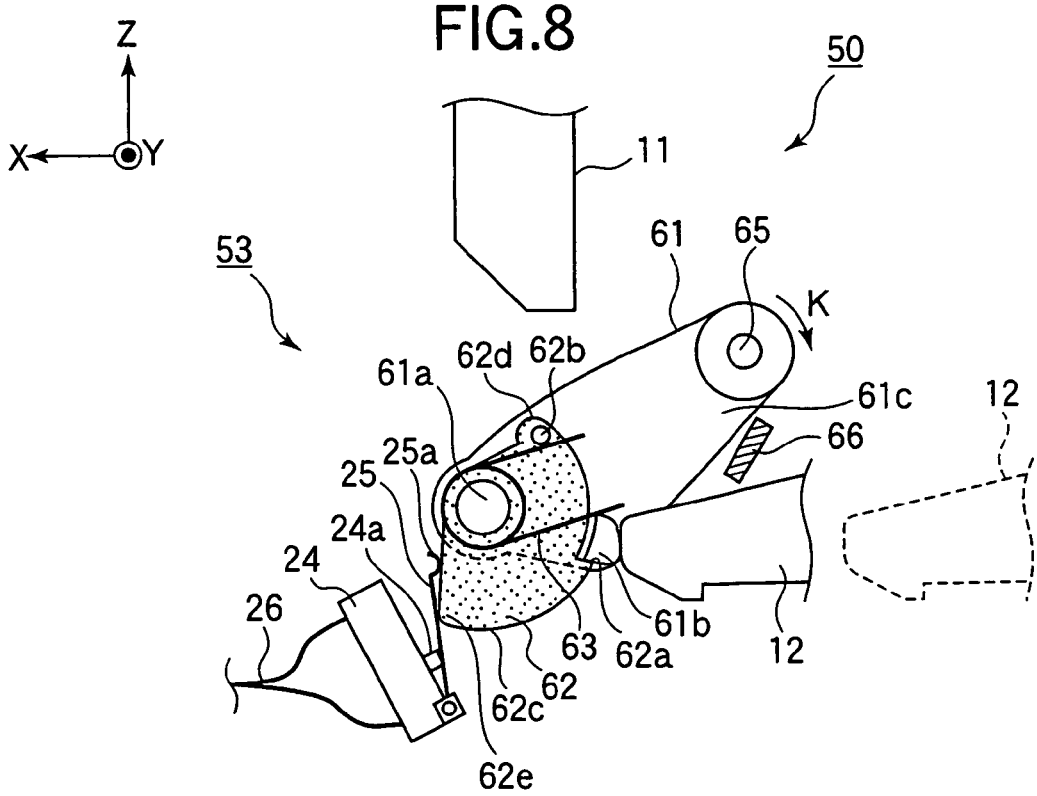

Referring to FIG. 9, the top cover 1001 and side cover 1002 are completely closed so that the projections 11 and 12 are at their closing positions. As the top cover 1001 is opened, the projection 11 moves from the closing position (solid lines) in FIG. 9 to the opening position (dotted lines) in FIG. 8. At this moment, the urging force of the torsion spring 63 causes the cam 62 to rotate counterclockwise, so that the cam 62 returns to the cam home position. In FIG. 8, the corner 62*e* of the cam 62 abuts the hinge lever 25 but does not press hard enough so that the hinge lever 25 no longer holds the micro switch 24 ON. As described above, upon detecting when the micro switch 24 shifts from the ON state to the OFF state, the detector 53 determines that at least one of the top cover 1001 and the side cover 1002 has been completely opened, and then notifies a control means, not shown, of the opening of the top cover 1001.

As described above, the micro switch 24 of the detecting mechanism 50 becomes OFF when at least one of the top cover 1001 and the side cover 1002 is opened, and ON only when both the top cover 1001 and the side cover 1002 are closed.

The detecting mechanism of the third embodiment includes only a small number of structural elements: a rotatable cam holder, a cam that is attached to the cam holder, and a torsion spring that urges the cam to rotate. Therefore, the detecting mechanism may be low in cost and capable of detecting whether two covers are opened or closed. The cam 62 rotates in one direction to make the micro switch ON, and rotates in the opposite direction to make the micro switch OFF when at least one of the top cover and side cover is opened. In other words, the detecting mechanism requires only a single urging means for urging the cam to rotate, and is capable of ensuring that the micro switch is made OFF. The cam is a generally sector-shaped molded piece, and is therefore inexpensive to manufacture. The cam has a circumferential edge having a constant radius with respect to the center about which the cam rotates. Thus, even when the top cover and side cover are pushed into the apparatus due to, for example, vibration, the circumferential surface merely slides on the hinge lever but does not cause the hinge lever to further pivot relative to the micro switch. Thus, the top cover and side cover are not strictly limited in their mechanical strength, which leads to lower manufacturing cost.

Fourth Embodiment

Figure 15:
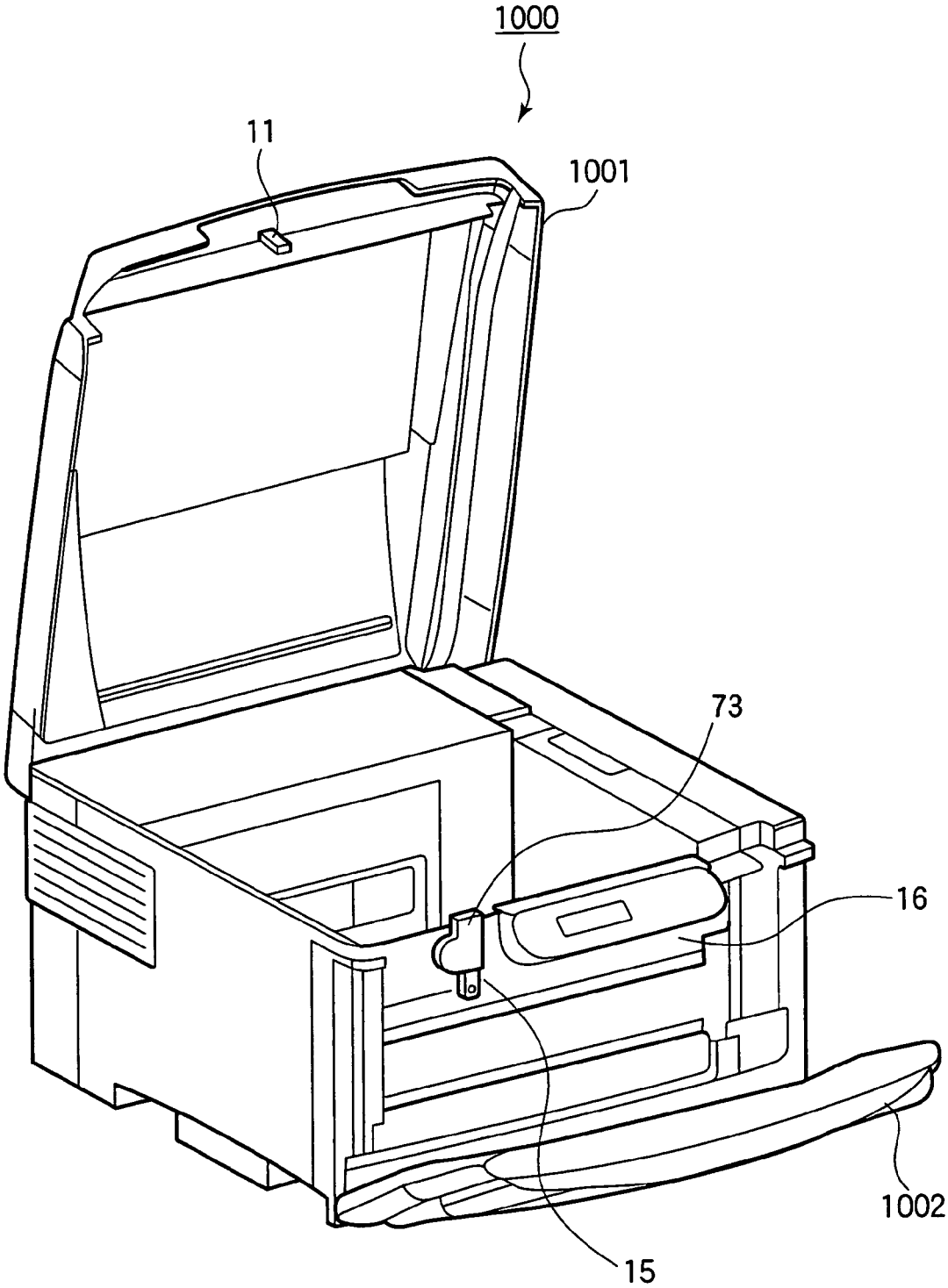
FIG. 15 is a perspective view of an image forming apparatus of a fourth embodiment when the top cover and the side cover are open.

FIG. 15 is a perspective view of an image forming apparatus of a fourth embodiment when a top cover 1001 and a side cover 1002 are open. For simplicity, the image forming sections 430 (FIG. 1) attached to the main body of the image forming apparatus 1000, and the LED head 433 (FIG. 1) are omitted from FIG. 15.

A detecting mechanism 70 of the fourth embodiment differs from the detecting mechanism 10 of the first embodiment in the configuration of a detector 73. Elements similar to those in the first embodiment have been given the same reference numerals and their description is omitted. The description will be given only of a portion different from the first embodiment.

Referring to FIG. 15, when the side cover 1002 is closed, the side cover 1002 faces a front plate 16 of the apparatus. The detector 73 is mounted to a top end portion of the front plate 16 by means of a screw 15 (FIG. 16A). A projection 11 of the top cover 1001 engages the detector 73 when the top cover 1001 is closed. A projection 12 of the side cover 1002 engages the detector 73 when the side cover 1002 is closed.

Figure 16B:
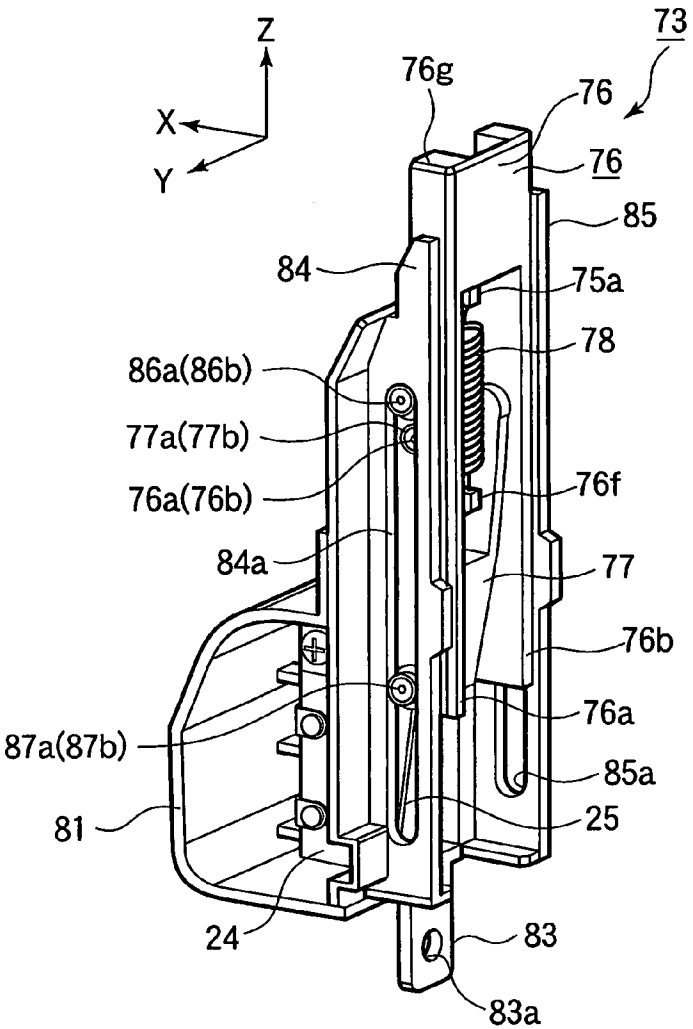
FIGS. 16A and 16B are perspective views of a detector a of a fourth embodiment as seen from different directions.
Figure 16A:
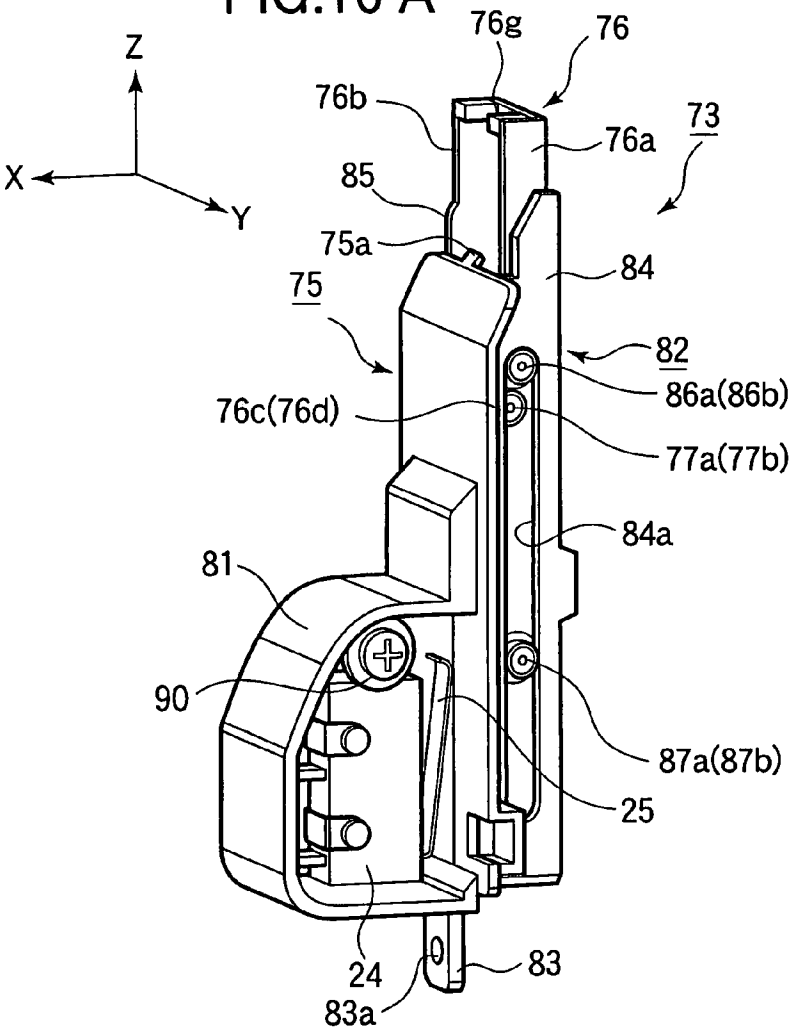

FIGS. 16A and 16B are perspective views of a detector 73 as seen from different directions. Referring to FIGS. 16A and 16B, the detector 73 include a base 75 having side walls 84 and 85, a holder 76, a swing member 77, a coil spring 78, and a micro switch 24. The base 75 is of one piece construction that includes a switch compartment 81 in which the micro switch 24 is housed, parallel side walls 84 and 85 that guide the upward and downward movements of the holder 76, and a mounting portion 83. A screw 15 extends through a hole 83*a* formed in the mounting portion 83, and is screwed into the front plate 16 for securely mounting the detector 73. The swing member 77 has a back surface 77*e* and beveled edge 77*d* that form a taper such that the swing member 77 is thicker at projections 77*a* and 77*b* than it is at its free end 77*c*. It is to be noted that the back surface 77*e* is configured to mate with the surface of the side cover 1002.

The side walls 84 and 85 are opposite from each other, and extend vertically (Z-direction). The side walls 84 and 85 are formed with guide holes 84*a* and 85*a*, respectively, elongated vertically (Z-direction). The holder 76 is held in a space defined between the side walls 84 and 85, and slides along the side walls 84 and 85. The holder 76 has two side plates 76*a* and 76*b* that extend in parallel planes. The holder 76 has a small plate 76*h* at its one longitudinal end portion, the small plate 76*h* connecting the two side plates 76*a* and 76*b* to form a generally U-shaped groove. A projection 86*a* projects outward from the side plate 76*a* into the guide hole 84*a*, and a projection 87*b* projects outward from the side plate 76*b* into the guide hole 85*a*. Thus, the holder 76 is supported on the base 75, and is guided by the side walls 84 and 85 in such a way that the holder 76 slides upward and downward (Z-direction) in the base 75.

Figure 17:
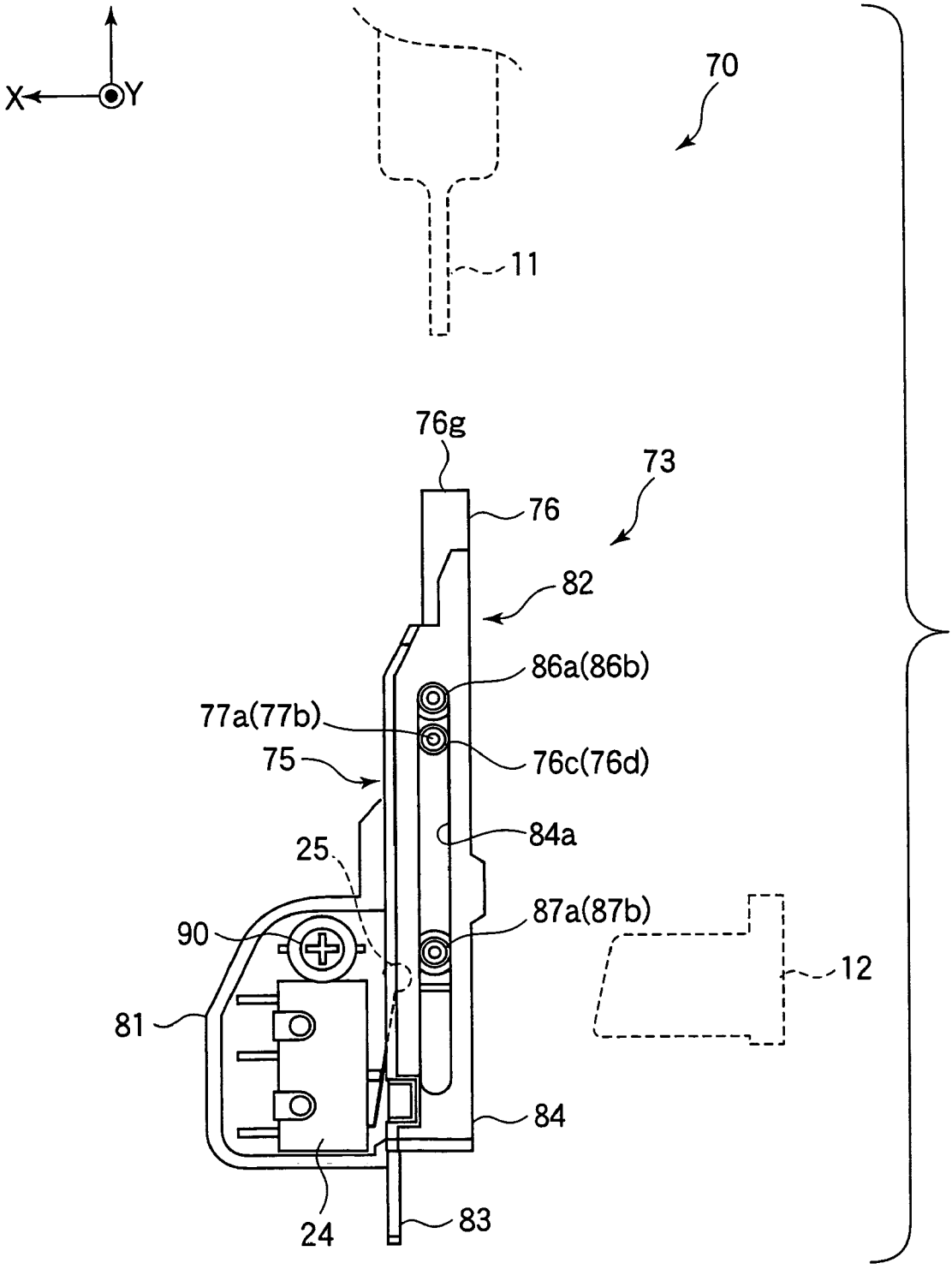
FIG. 17 is a front view illustrating the detecting mechanism when the top cover and the side cover are opened.

FIG. 17 is a front view illustrating the detecting mechanism 70 when the top cover 1001 and the side cover 1002 are opened. The projection 11 formed on the top cover 1001 and the projection 12 formed on the side cover 1002 are at their opening positions when the top cover 1001 and side cover 1002 are completely opened or partially opened. The opening position is shown in dotted lines in FIGS. 17 and 18 (also FIGS. 19-23). When the projections 11 and 12 are at their opening positions, the hinge lever 25 is at a position where the hinge lever 25 does not make the micro switch ON.

Figure 18:
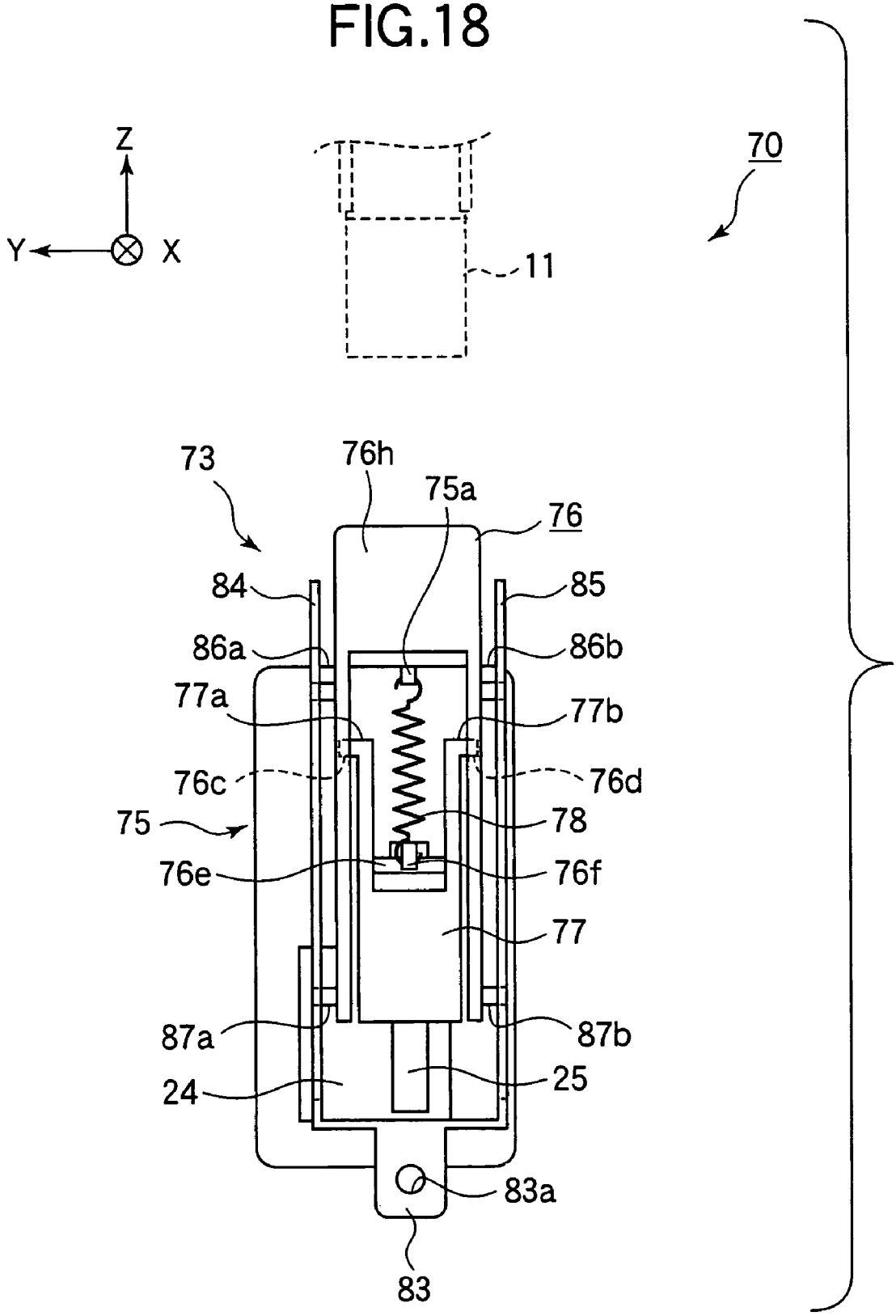
FIG. 18 is a side view illustrating the detecting mechanism.

FIG. 18 is a side view illustrating the detecting mechanism 70. The swing member 77 has the beveled edge 77*d* (FIG. 19), and includes the projections 77*a* and 77*b* that loosely fit into holes 76*c* and 76*d* so that the swing member 77 is held to swing. The coil spring 78 has one end coupled to a hook 75*a* formed on the base 75 and another end coupled to a hook 76*f* formed on the middle bar 76*e* extending across the side plates 76*a* and 76*b*. When the projection 11 moves from the opening position to the closing position and pushes the holder 76, the coil spring 78 urges the holder 76 upward (Z-direction) with respect to the base 75 fixed to the front plate 16.

The micro switch 24 is fixed in the switch compartment 81 of the base 75 by means of a screw. The switch compartment 81 has an opening through which the swing member 77 can access the hinge lever 25.

FIGS. 19-23 are side views illustrating the operation of the detecting mechanism 70. The operation of the detecting mechanism 70 of the aforementioned configuration will be described with reference to FIGS. 19-23. For simplicity's sake, only the hook 75*a* is shown as the base 75 and only hook 76*f* is shown as the lens holder 76 throughout FIGS. 19-23. Thus, the hook 76*f*, top end 76*g*, and projection 77*a* (77*b*) move in unison.

{Top Cover Closed First and then Side Cover Closed}

Figure 19:
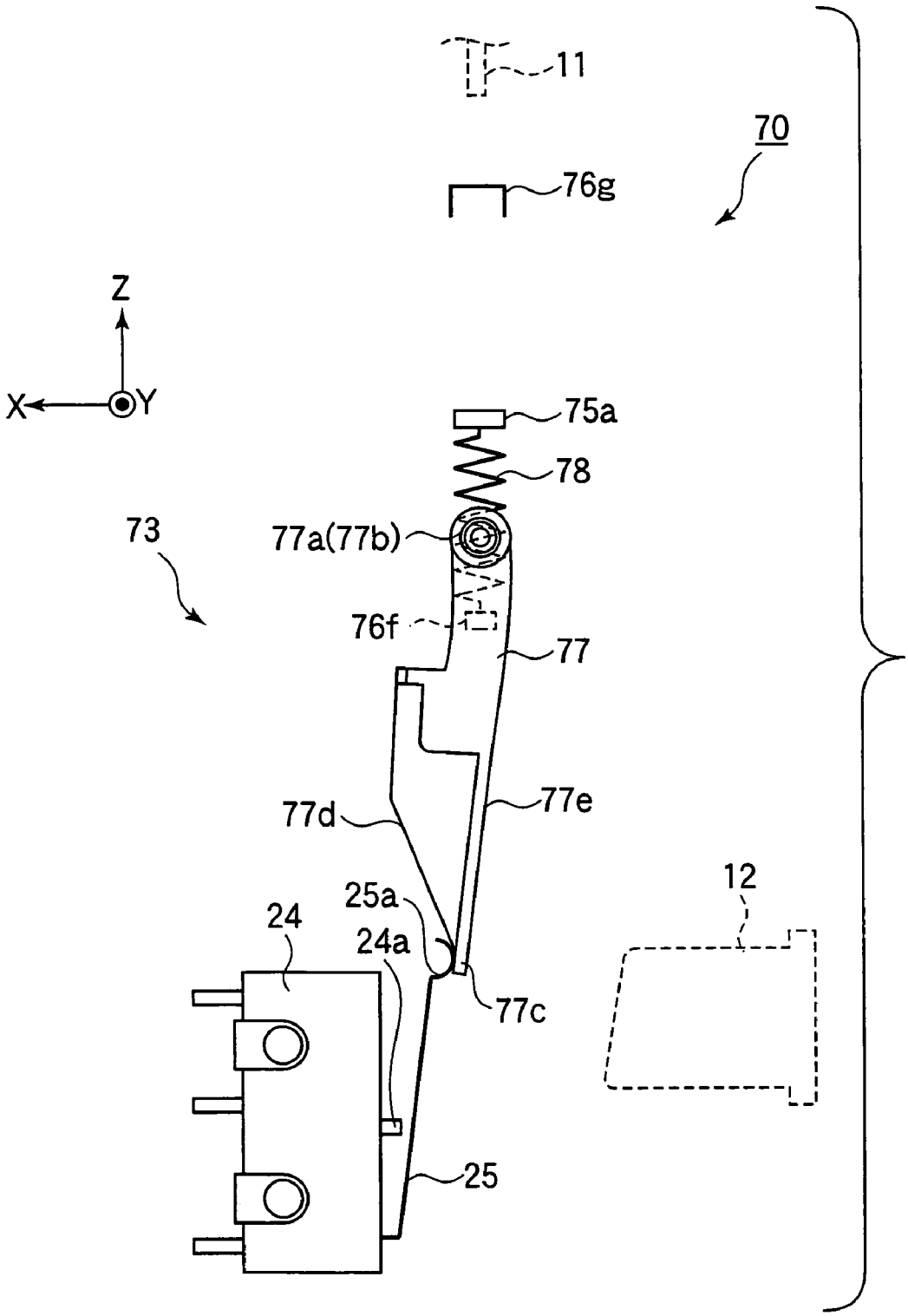
FIGS. 19-23 are side views illustrating the operation of the detecting mechanism.

FIG. 19 illustrates the projection 11 formed on the top cover 1001 and the projection 12 formed on the side cover 1002 when they are at their opening positions. The operation will be described in which the top cover 1001 is first closed and then the side cover 1002 is closed. This operation will be described with reference to FIGS. 19-21.

Figure 20:
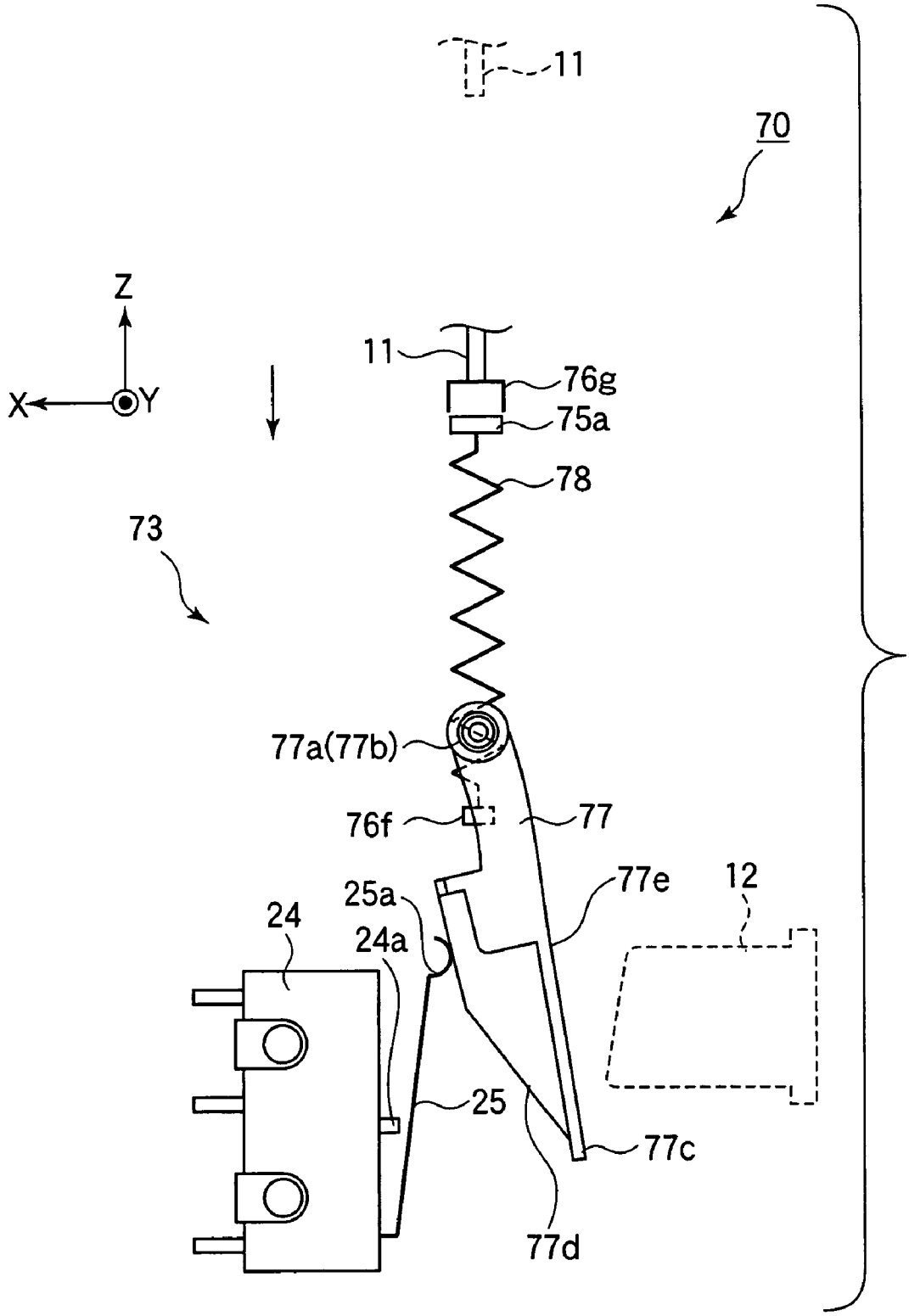

As the top cover 1001 is closed, the projection 11 moves from the opening position (dotted lines) in FIG. 20 to the closing position (solid lines) in FIG. 20. The projection 11 engages the top end 76*g* and causes the holder 76 to move downward (Z-direction) against the urging force of the stretched spring 78 toward the micro switch 24. As the holder 76 moves downward, the swing member 77 swings counterclockwise about the projections 77*a* and 76*a* with the beveled edge 77*d* in contact with the tip portion 25*a* of the hinge lever 25. Thus, the swing member 77 does not act on the hinge lever 25 so that the micro switch 24 remains OFF.

Subsequently, as the side cover 1002 is closed, the projection 12 moves from the opening position (dotted lines) in FIG. 21 to the closing position in FIG. 21. At this moment, the side cover 1002 acts on the back surface 77*e* of the swing member 77 to cause the swing member 77 to swing clockwise in a direction shown by arrow V. The swing member 77 swings to cause the hinge lever 25 to pivot counterclockwise. Thus, the hinge lever 25 depresses the switch button 24*a* of the micro switch 24 so that the micro switch 24 becomes ON.

As described above, upon detecting when the micro switch 24 shifts from the OFF state to the ON state, the detector 73 determines that the top cover 1001 and side cover 1002 have been completely closed, and then notifies a control means, not shown, of the closing of the top cover 1001 and side cover 1002.

{Side Cover First Closed and then Top Cover Closed}

The operation will be described in which the side cover 1002 is first closed and then the top cover 1001 is closed.

Figure 22:
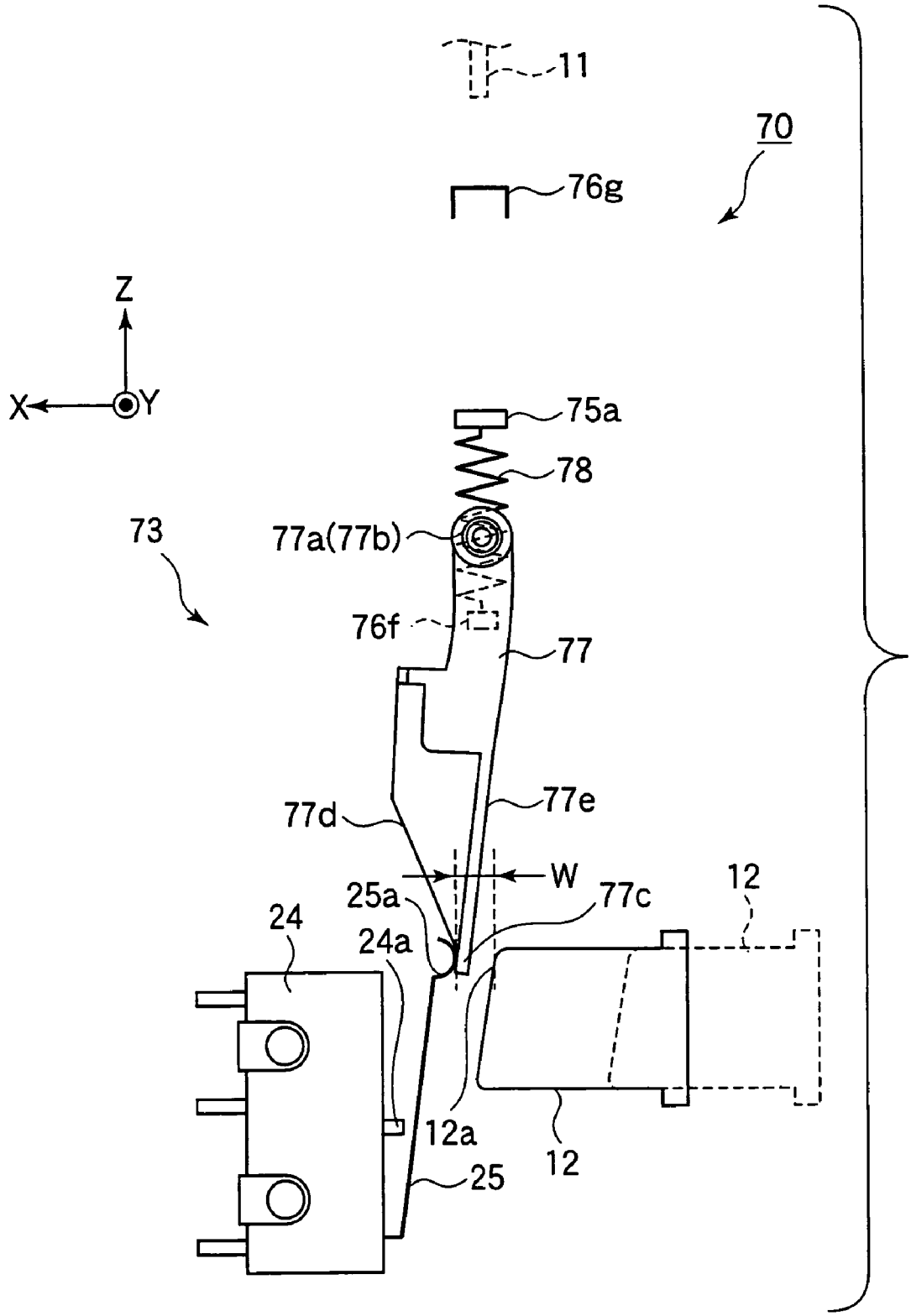

As the side cover 1002 is closed, the projection 12 moves from the opening position (dotted lines) in FIG. 22 to the closing position (solid lines) in FIG. 22. At this moment, the projection 12 does not act on the swing member 77.

Figure 23:
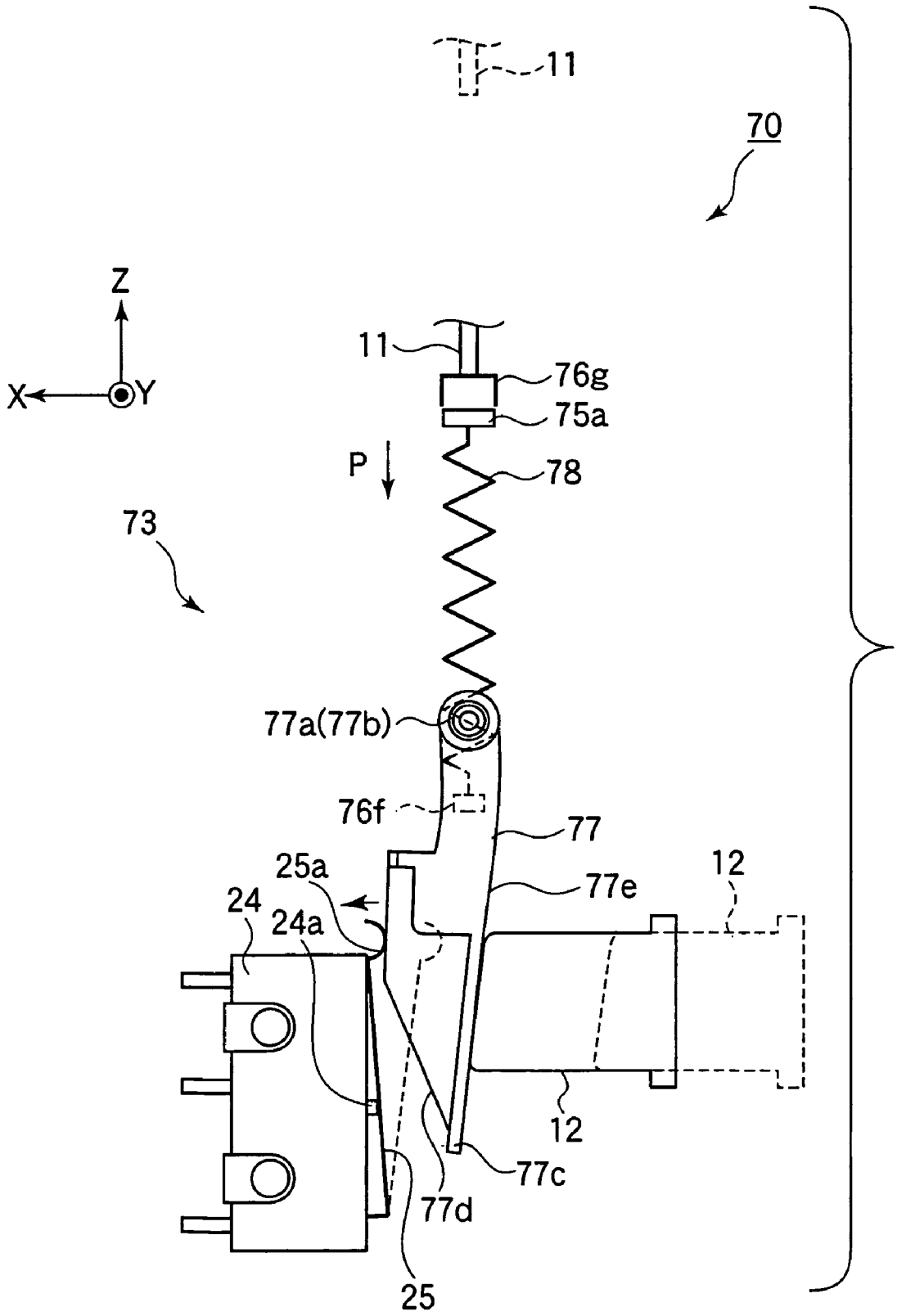

Then, as the top cover 1001 is closed, the top cover 11 moves from the opening position (dotted lines) in FIG. 22 to the closing position (solid lines) in FIG. 23, pushing the top end 76*g* of the holder 76 toward the gap between the micro switch 24 and the projection 12 against the urging force of the coil spring 78. The swing member 77 swings somewhat counterclockwise with the beveled edge 77*d* sliding on the tip portion 25*a* of the hinge lever 25. As the swing member 77 moves further into the gap between the hinge lever 25 and the projection 12, the beveled edge 77*d* slides on the tip portion 25*a* while the back surface 77*e* slides on the projection 12. As a result, the beveled edge 77*d* pushes the hinge lever 25 so that the hinge lever 25 pivots counterclockwise to depress the switch button 24*a* of the micro switch 24. Thus, the micro switch 24 becomes ON.

As described above, upon detecting when the micro switch 24 shifts from the OFF state to the ON state, the detector 73 determines that both the top cover 1001 and the side cover 1002 are closed, and then notifies a control means, not shown, of the closing of the top cover 1001 and side cover 1002.

{At Least One of Top Cover and Side Cover Opened}

The operation will be described in which the detecting mechanism 70 detects that at least one of the top cover 1001 and the side cover 1002 is opened.

Figure 21:
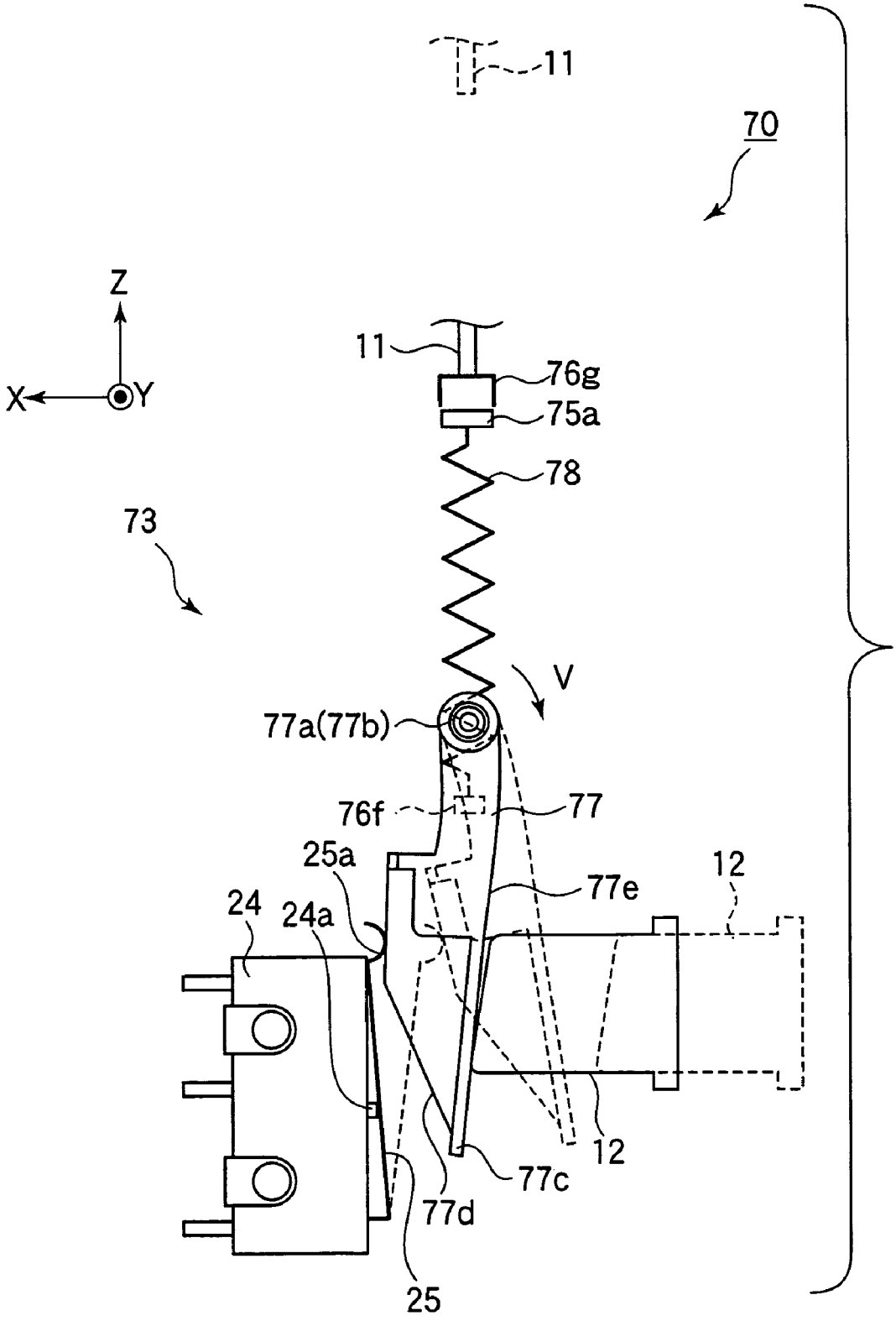

As the side cover 1002 is opened, the projection 12 move from the closing position (solid lines) in FIG. 21 to the opening position (solid lines) in FIG. 21. This movement of the projection 12 sets the swing member 77 and the hinge lever 25 free, allowing the hinge lever 25 to move out of pressing engagement with the switch button 24*a*. Thus, the micro switch 24 becomes OFF. As described above, upon detecting when the micro switch 24 shifts from the ON state to the OFF state, the detector 73 determines that at least one of the top cover 1001 and the side cover 1002 is opened, and then notifies a controlling means, not shown, of the opening of the top cover 1001 and side cover 1002.

Referring to FIG. 23, the top cover 1001 and the side cover 1002 are closed. As the top cover 1001 is opened, the projection 11 moves in a direction shown by arrow P from the closing position (solid lines) in FIG. 23 to the opening position (dotted lines) in FIG. 22, allowing the holder 76 to move away from the gap between the micro switch 24 and the projection 12 until the projections 86*a* and 86*b* of the holder 76 reach the upper ends of the guide holes 84*a* and 85*a*. When the projections 86*a* and 86*b* have reached the upper ends of the guide holes 84*a* and 85*a*, respectively, a tip 77*c* of the swing member 77 lightly contacts the tip portion 25*a* of the hinge lever 25 so that the hinge lever 25 no longer depresses the switch button 24*a*, allowing the micro switch 24 to become OFF. As described above, upon detecting when the micro switch 24 shifts from the ON state to the OFF state, the detector 73 determines that at least one of the top cover 1001 and the side cover 1002 is opened, and then notifies the controlling mean, not shown, of the closing of the top cover 1001 and side cover 1002.

As described above, the micro switch 24 becomes OFF when at least one of the top cover 1001 and the side cover 1002 is opened, and ON only when both the top cover 1001 and the side cover 1002 are closed.

When the swing member 77 is in the position in FIG. 22 (i.e., the coil spring is in its relaxed state), the tip portion 77*c* is within the range W between the tip portion 25*a* of the hinge lever 25 and an upper corner 12*a* of the projection 12, and projecting slightly in to the gap between the hinge lever 25 and the projection 12. The swing member 77 is prevented from moving upward any further than the position in FIG. 22. Therefore, when the swing member 77 moves downward into the gap, the movement of the swing member 77 is not interfered with the hinge lever 25 and/or the projection 12.

Just as in the first embodiment, the use of only one detector such as a micro switch enables detection of whether at least one of the two covers is opened, and eliminates the need for a plurality of switches and hardware for checking the detection results of the plurality of switches. This simplifies the overall configuration of the detecting mechanism, reducing the number of parts for cost reduction as well as improving reliability of the detecting mechanism. In addition, fixing the micro switch to the main body of the apparatus would solve problems such as cutting off of leads connected to the micro switch and interference of leads against the movement of the micro switch that would occur if the micro switch is not stationary. Thus, the overall size of the detecting mechanism can be small.

While the swing member 77 has been described as being supported free to swing, the swing member 77 may be configured such that a small returning-force acts on the swing member 77.

Fifth Embodiment

The fifth embodiment differs from the fourth embodiment in the configuration of projections 91 and 92. The elements similar to those in the fourth embodiment have been given the same reference numerals and the description is omitted.

Figure 24:
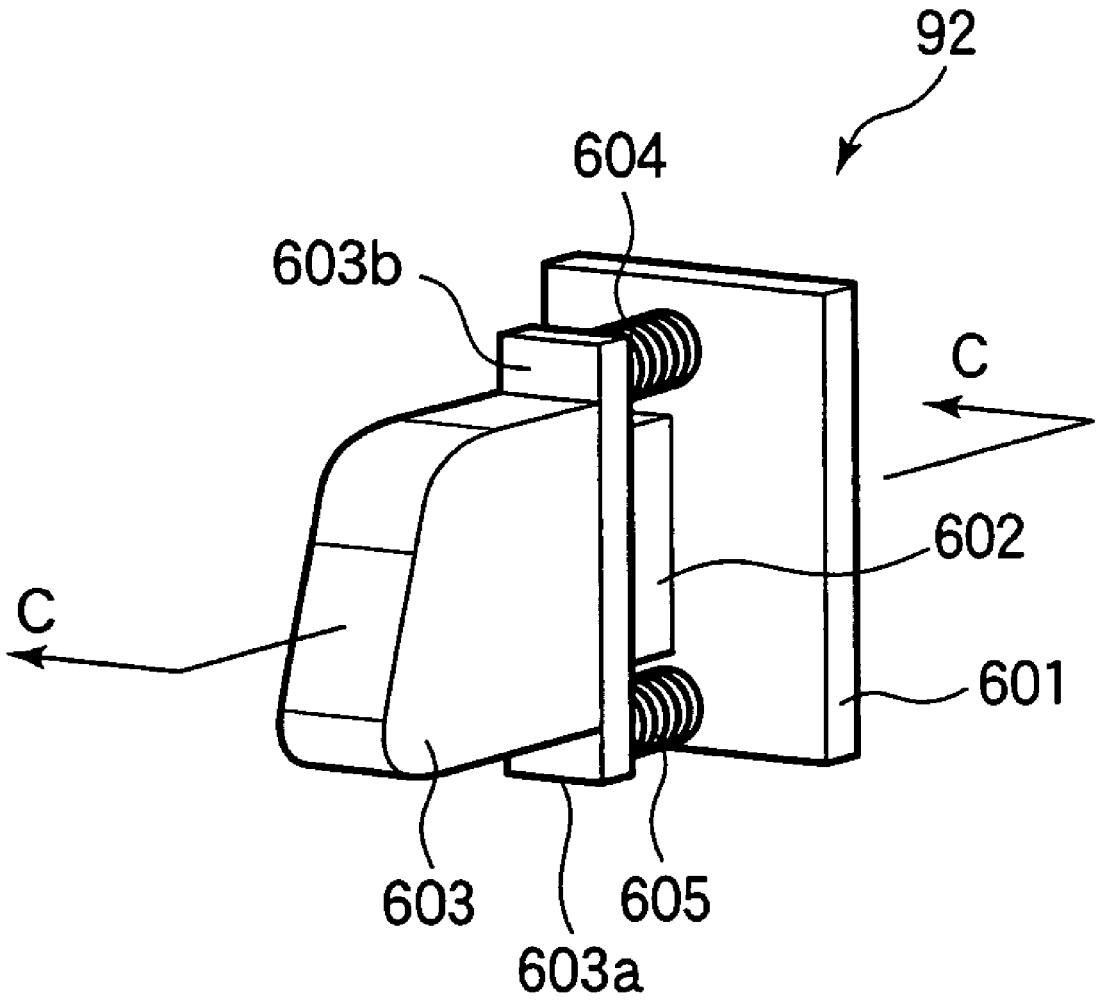
FIG. 24 is a perspective view illustrating a projection for the top cover of a fifth embodiment.

FIG. 24 is a perspective view illustrating a projection 92 for the top cover 1001.

Figure 25:
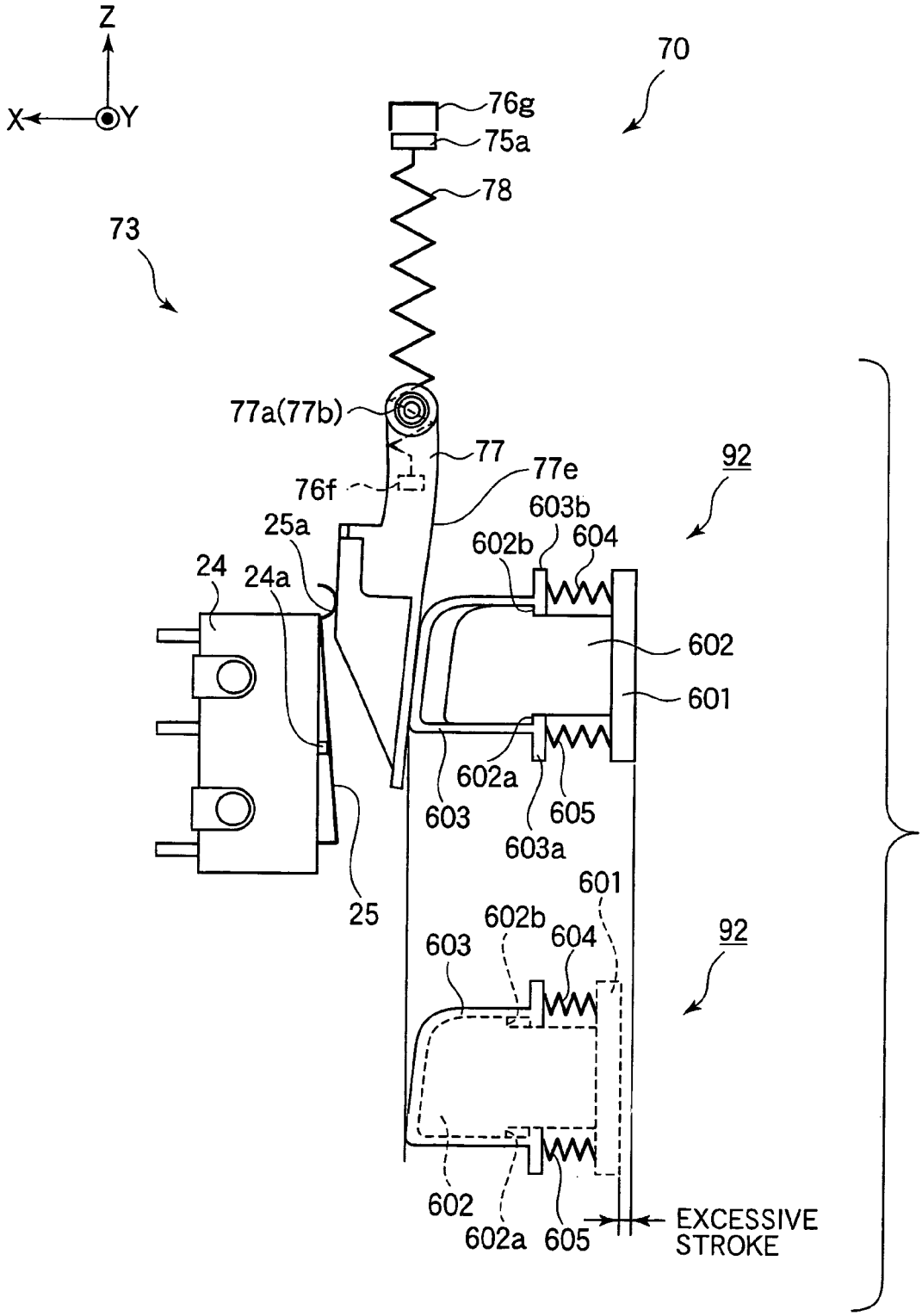
FIG. 25 is a side view of the fifth embodiment with a cross sectional view taken along a line C-C of FIG. 24.

FIG. 25 is a side view of the fifth embodiment with a cross sectional view taken along a line C-C of FIG. 24, and illustrates the operation of the projection 92. The projection 92 includes a base 601, a guide 602, a cap 603, and coil springs 604 and 605. The cap 603 is formed of a resin material and includes projections 603*a* and 603*b* extending inward and outward. The guide 602 includes stepped portions 602*a* and 602*b*. The cap 603 slidably fits over the guide 602, and is urged by the coil springs 604 and 605 in a direction away from the guide 602 such that the projections 603*a* and 603*b* of the cap 603 abut the stepped portions 602*a* and 602*b*.

As the side cover 1002 is closed after the top cover 1001 has been closed, the cap 603 in FIG. 25 abuts the back surface 77*e* of the swing member 77 causing the swing member 77 to swing until the swing member 77 causes the hinge lever 25 to make the micro switch 24 ON. A stopper means, not shown, prevents the swing member 77 from further swinging from the position in FIG. 25.

The fifth embodiment provides for excessive stroke of the top cover 1001 and side cover 1002. In other words, the apparatus is configured such that the side cover 1002 is pushed a certain distance further than the closing position before the side cover 1002 is locked by a locking means, not shown. Thus, when the side cover 1002 is pushed a certain distance further than the closing position, the base 601 and guide 602 move to a dotted line position in FIG. 25 against the urging forces of the coil springs 604 and 605 while the cap 603 remains at rest.

In other words, the configuration of the projection 92 absorbs the excessive stroke of the side cover 1002, thereby preventing an excessive load from being exerted on the swing member 77.

Figure 26:
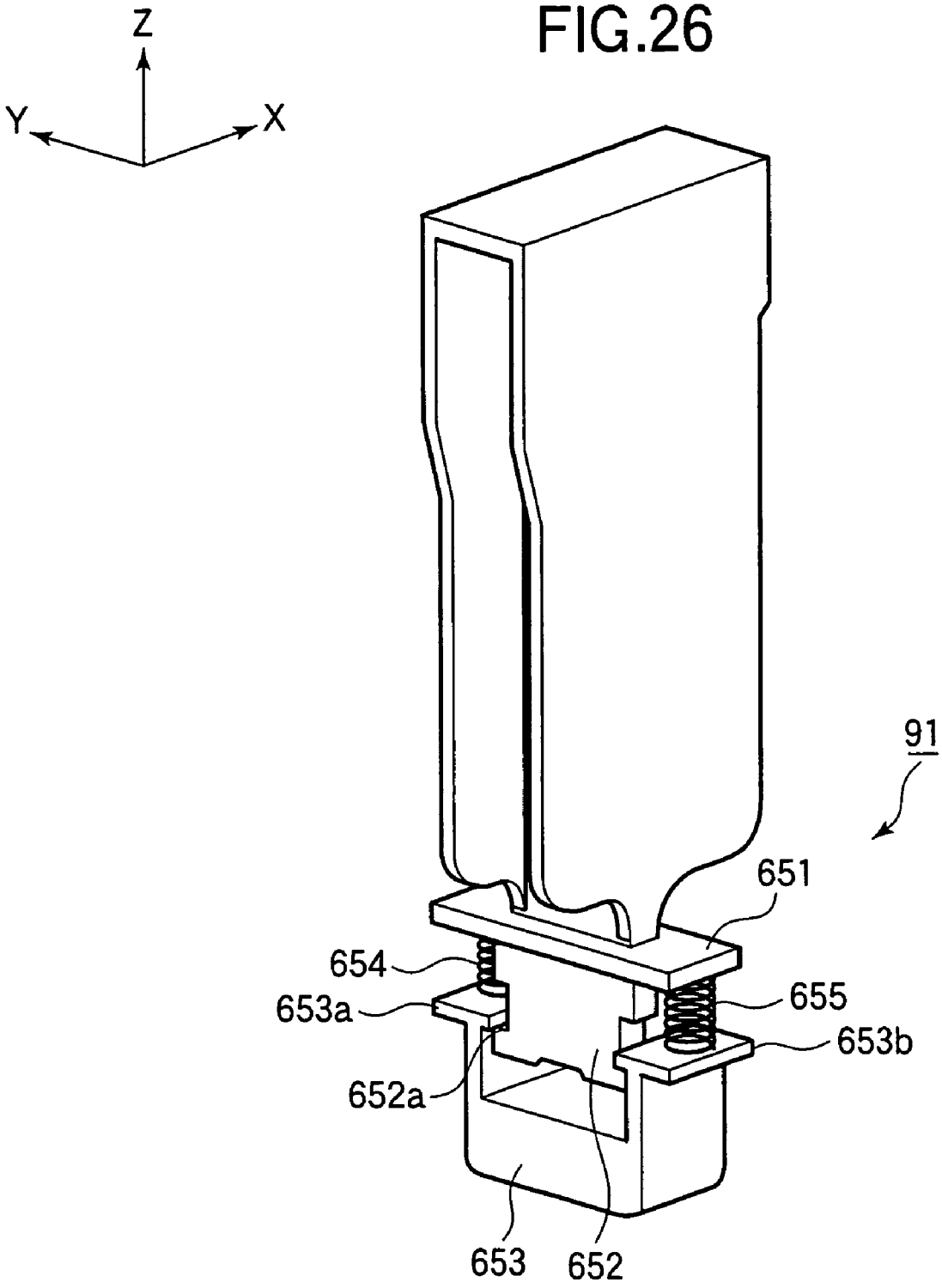
FIG. 26 is a perspective view illustrating a projection for the side cover.
Figure 27:
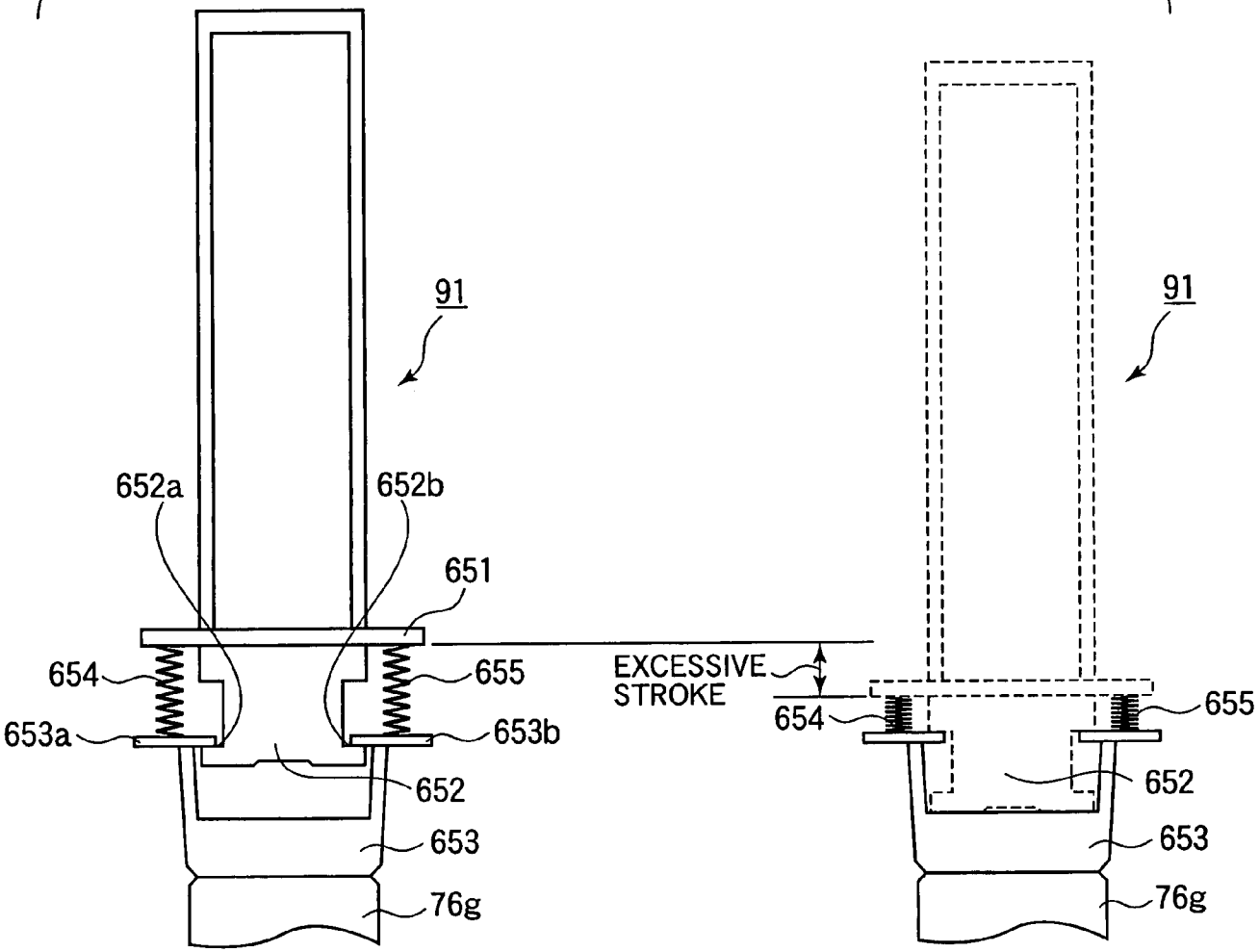
FIG. 27 is a fragmentary side view of the projection for the top cover.

FIG. 26 is a perspective view illustrating a projection 91 for the side cover 1002. FIG. 27 is a fragmentary side view of the projection 91. The projection 91 includes a base 651, a guide 652, a cap 653, and compressed coil springs 654 and 655. The cap 653 is formed of a resin material, and includes projections 653*a* and 653*b* extending inward and outward. The guide 652 includes stepped portions 652*a* and 652*b*. The cap 603 slidably fits over the guide 652, and is urged in a direction away from the guide 652 such that the projections 653*a* and 653*b* of the cap 653 abut the stepped portions 652*a* and 652*b* (FIG. 27). The coil spring 654 is mounted across the base 651 and projection 653*a*, and the coil spring 655 is mounted across the base 651 and projection 653*b*. The coil springs 654 and 655 urge the cap 653 in a direction away from the guide 652.

As described above, when the top cover 1001 is closed after the side cover 1002 has been closed, the cap 653 first abuts the top end 76*g* of the holder 76 and depresses the top end 76*g*, thereby allowing the swing member 77 to push the hinge lever 25 so that the micro switch becomes ON. The holder 76 moves downward until the projections 87*a* and 87*b* are stopped by the lower ends of the guide holes 84*a* and 85*a*.

The fifth embodiment is configured such that the top cover 1001 is locked by a locking means, not shown. Thus, the top cover 1001 is expected to be pushed into the apparatus further than the closing position. As the top cover 1001 is pushed into the apparatus further than the closing position, the base 601 moves to a dotted line position in FIG. 27 against the urging forces of the coil springs 654 and 655 while the cap 603 does not move.

In other words, the configuration of the projection 91 absorbs the excessive stroke of the top cover 1001, thereby preventing an excessive load from being exerted on the swing member 77. The excessive stroke of the top cover 1001 ensures the locking operation of the top cover 1001.

The first to fifth embodiments have been described with respect to an electrophotographic image forming apparatus. The present invention is not limited to these embodiments, and may be applicable to image forming apparatuses such as a facsimile machine, an ink jet printer, a copying machine, and a composite apparatus of these where more than one covering member are employed and have to be closed simultaneously before the apparatus becomes operable.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

two covers pivotally mounted to a body of the image forming apparatus, each of said two covers being movable either to its opening position to open with respect to the image forming apparatus or to its closing position to close with respect to the image forming apparatus, a movable member positioned at a first position when said two covers are at their opening positions; and a detector that detects whether said two covers are closed or opened with respect to the image forming apparatus;

wherein when one of said two covers has moved to its closing position causing said movable member to move to a second position and the other of said two covers is at its closing position, said detector detects that said two covers are closed with respect to the image forming apparatus;

wherein said detector is a switch, the switch being in one state when said two covers are at their closing positions and in another state when at least one of said two covers is at its opening position;

wherein said movable member includes a cam that rotates about an axis and that is urged by an urging member in a first direction, wherein after a first one of said two covers has moved from its opening position to its closing position to push the cam to rotate against an urging force of the urging member, a second one of said two covers moves from its opening position to its closing position to push said movable member to the second position, the cam rotating to cause the switch to shift.

2. An image forming apparatus, comprising:

two covers pivotally mounted to a body of the image forming apparatus, each of said two covers being movable either to its opening position to open with respect to the image forming apparatus or to its closing position to close with respect to the image forming apparatus;

a movable member positioned at a first position when said two covers are at their opening positions; and a detector that detects whether said two covers are closed or opened with respect to the image forming apparatus, wherein when one of said two covers has moved to its closing position causing said movable member to move to a second position and the other of said two covers is at its closing position, said detector detects that said two covers are closed with respect to the image forming apparatus;

wherein said detector is a switch, the switch being in one state when said two covers are at their closing positions and in another state when at least one of said two covers is at its opening position;

wherein said movable member includes a cam that rotates about an axis and that is urged by an urging member in a first direction, wherein a first one of said two covers moves from its opening position to its closing position to push the cam to rotate against an urging force of the urging member after a second one of said two covers moves from its opening position to its closing position to push said movable member to the second position, the cam rotating to cause the switch to shift.

3. An image forming apparatus, comprising:

two covers pivotally mounted to a body of the image forming apparatus, each of said two covers being movable either to its opening position to open with respect to the image forming apparatus or to its closing position to close with respect to the image forming apparatus;

a movable member positioned at a first position when said two covers are at their opening positions; and a detector that detects whether said two covers are closed or opened with respect to the image forming apparatus;

wherein when one of said two covers has moved to its closing position causing said movable member to move to a second position and the other of said two covers is at its closing position, said detector detects that said two covers are closed with respect to the image forming apparatus; and a movable engagement member pivotally mounted to said movable member, said movable engagement member being at a third position when said two covers are at their opening positions;

wherein when a first one of said two covers has moved to its closing position causing said movable member to move to the second position and a second one of said two covers moves to its closing position causing said movable engagement member to pivot to a fourth position, said movable engagement member causes said detector to detect that said two covers are closed with respect to the image forming apparatus.

4. The image forming apparatus according to claim 3, wherein said detector is a switch, the switch being in one state when said two covers are at their closing positions and in another state when at least one of said two covers is at its opening position.

5. The image forming apparatus according to claim 4, wherein said movable engagement member is a cam that rotates about an axis and that is urged by an urging member in a first direction, wherein after the first one of said two covers has moved from its opening position to its closing position to push the cam to rotate against an urging force of the urging member, the second one of said two covers moves from its opening position to its closing position to push said movable member to the second position, the cam rotating to cause the switch to shift.

6. The image forming apparatus according to claim 5, wherein the cam has a circular edge, wherein when the cam rotates, the circular edge moves into engagement with the switch to shift the switch.

7. The image forming apparatus according to claim 4, wherein said movable engagement member is a cam that rotates about an axis and that is urged by an urging member in a first direction, wherein the first one of said two covers moves from its opening position to its closing position to push the cam to rotate against an urging force of the urging member after the second one of said two covers moves from its opening position to its closing position to push said movable member to the second position, the cam rotating to cause the switch to shift.

8. The image forming apparatus according to claim 7, wherein the cam has a circular edge, wherein when the cam rotates, the circular edge moves into engagement with the switch to shift the switch.

* * * * *